US011633079B2

(12) United States Patent
Zhang et al.

(10) Patent No.: US 11,633,079 B2
(45) Date of Patent: Apr. 25, 2023

(54) BASE STATION AND CLEANING ROBOT SYSTEM

(71) Applicant: Yunjing Intelligence Technology (Dongguan) Co., Ltd., Dongguan (CN)

(72) Inventors: Junbin Zhang, Dongguan (CN); Weijin Lin, Dongguan (CN)

(73) Assignee: Yunjing Intelligence Technology (Dongguan) Co., Ltd., Dongguan (CN)

( * ) Notice: Subject to any disclaimer, the term of this patent is extended or adjusted under 35 U.S.C. 154(b) by 86 days.

(21) Appl. No.: 17/227,562

(22) Filed: Apr. 12, 2021

(65) Prior Publication Data

US 2021/0228044 A1 Jul. 29, 2021

Related U.S. Application Data

(63) Continuation of application No. 16/469,658, filed as application No. PCT/CN2016/110380 on Dec. 16, 2016.

(51) Int. Cl.
*A47L 11/40* (2006.01)
*A47L 11/282* (2006.01)

(52) U.S. Cl.
CPC ..... *A47L 11/40* (2013.01); *A47L 11/282* (2013.01); *A47L 11/4091* (2013.01); *A47L 2201/028* (2013.01)

(58) Field of Classification Search
CPC .... A47L 11/282; A47L 11/40; A47L 11/4016; A47L 11/4038; A47L 11/4083; A47L 11/4091; A47L 2201/028
See application file for complete search history.

(56) References Cited

U.S. PATENT DOCUMENTS 5,815,880 A 10/1998 Nakanishi
8,087,117 B2 1/2012 Kapoor et al.
(Continued)

FOREIGN PATENT DOCUMENTS

CN 2452445 Y 10/2001
CN 2664578 Y 12/2004
(Continued)

OTHER PUBLICATIONS

First Office Action issued in Chinese Patent Application No. 201611169197.7. dated Dec. 18, 2017.
(Continued)

*Primary Examiner* — Randall E Chin
(74) *Attorney, Agent, or Firm* — Leydig, Voit & Mayer, Ltd.

(57) ABSTRACT

The present disclosure relates to the field of cleaning robot technology, and in particular to a cleaning robot system. The cleaning robot system includes a base station and a cleaning robot. The base station is independent to the cleaning robot of the cleaning robot system. The base station includes a base station body and a mop member cleaning device arranged on the base station body. The mop member cleaning device is configured to clean a mop member of the cleaning robot. Based on the base station, the cleaning robot system is capable of automatically cleaning the mop member with no need for users to change or clean the mop member frequently, which is helpful to free consumers from house cleaning, thus relieving the burden on the consumers, and also helpful to clean the mop member in time so as to ensure a better effect in next cleaning.

20 Claims, 24 Drawing Sheets

(56) References Cited

U.S. PATENT DOCUMENTS

| | | | |
|---|---|---|---|
| 8,418,303 | B2 | 4/2013 | Kapoor et al. |
| 8,528,157 | B2 | 9/2013 | Schnittman et al. |
| 8,572,799 | B2 | 11/2013 | Won et al. |
| 8,756,751 | B2 | 6/2014 | Jung et al. |
| 9,027,199 | B2 | 5/2015 | Jung et al. |
| 9,186,030 | B2 | 11/2015 | Jung et al. |
| 9,492,048 | B2 | 11/2016 | Won et al. |
| 9,775,476 | B2 | 10/2017 | Jang et al. |
| 10,028,631 | B2 | 7/2018 | Jung et al. |
| 2005/0241086 | A1 | 11/2005 | Damrath et al. |
| 2006/0190133 | A1 | 8/2006 | Konandreas et al. |
| 2008/0047092 | A1 | 2/2008 | Schnittman et al. |
| 2008/0052846 | A1 | 3/2008 | Kapoor et al. |
| 2009/0044370 | A1 | 2/2009 | Won et al. |
| 2010/0011529 | A1 | 1/2010 | Won et al. |
| 2010/0107355 | A1 | 5/2010 | Won et al. |
| 2011/0202175 | A1 | 8/2011 | Romanov et al. |
| 2012/0011676 | A1 | 1/2012 | Jung et al. |
| 2012/0011677 | A1 | 1/2012 | Jung et al. |
| 2012/0013907 | A1 | 1/2012 | Jung et al. |
| 2012/0084937 | A1 | 4/2012 | Won et al. |
| 2012/0159725 | A1 | 6/2012 | Kapoor et al. |
| 2013/0205520 | A1 | 8/2013 | Kapoor et al. |
| 2013/0298350 | A1 | 11/2013 | Schnittman et al. |
| 2013/0340201 | A1 | 12/2013 | Jang et al. |
| 2014/0053351 | A1 | 2/2014 | Kapoor et al. |
| 2014/0109339 | A1 | 4/2014 | Won et al. |
| 2014/0130272 | A1 | 5/2014 | Won et al. |
| 2014/0184144 | A1 | 7/2014 | Henricksen et al. |
| 2015/0082579 | A1 | 3/2015 | Lin |
| 2015/0148949 | A1 | 5/2015 | Chin et al. |
| 2016/0029865 | A1 | 2/2016 | Jung et al. |
| 2017/0055796 | A1 | 3/2017 | Won et al. |
| 2018/0296051 | A1 | 10/2018 | Jung et al. |

FOREIGN PATENT DOCUMENTS

| | | | | |
|---|---|---|---|---|
| CN | 1655715 | A | | 8/2005 |
| CN | 1889881 | A | | 1/2007 |
| CN | 101524260 | A | | 9/2009 |
| CN | 101884509 | A | | 11/2010 |
| CN | 201790777 | U | | 4/2011 |
| CN | 102334945 | A | | 2/2012 |
| CN | 103006153 | A | | 4/2013 |
| CN | 203138415 | U | | 8/2013 |
| CN | 103505155 | A | | 1/2014 |
| CN | 203576426 | U | | 5/2014 |
| CN | 203763006 | U | | 8/2014 |
| CN | 104207734 | A | | 12/2014 |
| CN | 204072011 | U | | 1/2015 |
| CN | 204260679 | U | | 4/2015 |
| CN | 104586324 | A | | 5/2015 |
| CN | 204379173 | U | | 6/2015 |
| CN | 204765491 | U | | 11/2015 |
| CN | 105496316 | A | | 4/2016 |
| CN | 205607493 | U | | 9/2016 |
| DE | 102010 017 211 | A1 | * | 12/2011 |
| DE | 102014108217 | A1 | | 12/2015 |
| EP | 2023788 | A2 | | 2/2009 |
| EP | 2394553 | A2 | | 12/2011 |
| EP | 2888981 | A2 | | 7/2015 |
| EP | 2 918 212 | A1 | * | 9/2015 |
| GB | 1392682 | A | | 4/1975 |
| JP | H07327897 | A | | 12/1995 |
| JP | 2005211426 | A | | 8/2005 |
| JP | 2006158814 | A | | 6/2006 |
| JP | 2007513659 | A | | 5/2007 |
| JP | 2014117608 | A | | 6/2014 |
| JP | 2016506788 | A | | 3/2016 |
| JP | 2016059677 | A | | 4/2016 |
| KR | 200431133 | Y1 | | 11/2006 |
| KR | 20090061461 | A | | 6/2009 |
| KR | 20140000811 | A | | 1/2014 |
| KR | 20150000141 | U | | 1/2015 |
| KR | 20150078093 | A | | 7/2015 |
| KR | 20150106266 | A | | 9/2015 |
| KR | 101654014 | B1 | | 8/2016 |
| KR | 101680884 | B1 | | 12/2016 |
| WO | 2005055795 | A1 | | 6/2005 |

OTHER PUBLICATIONS

First Office Action issued in Chinese Patent Application No. 201611169198.1. dated Dec. 1, 2017.

International Search Report and Written Opinion issued in corresponding PCT Application No. PCT/CN2016/110380, dated Aug. 30, 2017.

Second Office Action issued in Chinese Patent Application No. 201611169197.7. dated May 31, 2018.

Second Office Action issued in Chinese Patent Application No. 201611169198.1. dated May 9, 2018.

Office Action in counterpart Japanese Application No. 2019-547746, dated Aug. 4, 2020.

Supplementary European Search Report in counterpart European Application No. 16924064.5, dated Jun. 25, 2020.

Written Opinion in counterpart Singapore Application No. 11201905405R, dated Apr. 30, 2020.

Office Action in counterpart Korean Application No. 10-2019-7017314, dated Sep. 29, 2020.

* cited by examiner

BASE STATION AND CLEANING ROBOT SYSTEM

CROSS REFERENCES TO RELATED APPLICATIONS

The present application is a continuation application of U.S. patent application Ser. No. 16/469,658, filed on Jun. 14, 2019, now pending which is the national stage of PCT application No. PCT/CN2016/110380, filed on Dec. 16, 2016, the entire contents of which are incorporated herein by reference.

FIELD

The present disclosure relates to the field of cleaning robot technology, and in particular to a base station and a cleaning robot system.

BACKGROUND

In recent years, with the development of social economy and living standards, house cleaning has gradually entered an era of intelligence and mechanization, along with which cleaning robots come into being. The cleaning robots may free people from the house cleaning, thereby to effectively reduce people's burden on house cleaning, as well as the level of fatigue.

Some cleaning robots having mops may also mop the floor when in use, so as to implement mopping function. However, the cleaning robots which can mop the floor still exist the following defects:

(1) The cleaning robot is not capable of automatically cleaning the mop, and the mop uncleaned can hardly effectively clean the house. Thus, users need to clean and change the mop frequently. This will burden the users and make it impossible to completely free users from floor mopping, in addition, it will lead to an ineffective floor cleaning due to a delayed washing or changing of the mop.

(2) The cleaning robot holds the mop against the floor by its gravity, and drags the mop to rub the floor for the purpose of cleaning. The relative motion between the mop and the floor is generated by only the movement of the cleaning robot itself. Therefore, an ineffective floor cleaning would occur due to a less relative motion between the mop and the floor.

SUMMARY

One technical problem to be solved is that the cleaning robots cannot automatically clean the mops and users need to change or clean the mops frequently.

To solve the aforementioned technical problem, the present disclosure provides a base station for a cleaning robot system. The cleaning robot system includes the base station and a cleaning robot. The cleaning robot includes a mop member that is configured to mop a floor surface. The base station is arranged to be independent to the cleaning robot of the cleaning robot system, and the base station includes a base station body and a mop member cleaning device arranged on the base station body. The mop member cleaning device is configured to clean the mop member.

Optionally, the mop member cleaning device includes a protruding structure. The protruding structure includes a protruding portion, and the protruding portion is in contact with the mop member during the process of the mop member cleaning device cleaning the mop member. And/or, the mop member cleaning device includes a cleaning roller, and the cleaning roller is in contact with the mop member during the process of the mop member cleaning device cleaning the mop member.

Optionally, the protruding portion is a curved protruding portion, a straight protruding portion, or a polyline protruding portion.

Optionally, the protruding structure includes at least two of the protruding portions. The at least two of the protruding portions are defined in radial arrangement and/or in array arrangement.

Optionally, the mop member cleaning device and the mop member are arranged to be rotatable relative to each other, and/or, the mop member cleaning device and the mop member are arranged to be movable relative to each other, during the process of the mop member cleaning device cleaning the mop member.

Optionally, the base station further includes a scraping and blocking member. The scraping and blocking member is configured to scrape rubbish off the mop member before the mop member gets in the mop member cleaning device; and/or, the scraping and blocking member is configured to prevent cleaning fluid from splashing during the process of the mop member cleaning device cleaning the mop member.

Optionally, the base station further includes a guiding structure defined on the mop member cleaning device. The guiding structure is configured to guide the cleaning robot to move relative to the mop member cleaning device, to allow the mop member to get in and out the mop member cleaning device.

Optionally, the guiding structure includes a guiding surface that is inclined obliquely downward from the mop member cleaning device and extends to the floor.

And/or, the guiding structure includes an upwardly projected guiding wheel. And/or, the guiding structure includes a guiding plate defined at a lateral side of the mop member cleaning device.

Optionally, the guiding structure includes the guiding surface and the guiding wheel. The guiding wheel is arranged on the guiding surface.

Optionally, the base station further includes a mop drying device. The mop drying device is configured to dry the mop member.

Optionally, the base station further includes a charging device arranged on the base station body. The charging device is configured to charge the cleaning robot.

Optionally, the mop member cleaning device includes a cleaning notch.

The cleaning notch is configured to place the mop member during the process of the mop member cleaning device cleaning the mop member.

Optionally, the mop member cleaning device further includes a fluid inlet structure, and cleaning fluid for cleaning the mop member is allowed to enter the cleaning notch through the fluid inlet structure. And/or, the mop member cleaning device further includes a fluid discharge structure, and the cleaning fluid after cleaning the mop member is allowed to be discharged outside of the cleaning notch through the fluid discharge structure.

Optionally, the base station further includes a cleaning fluid supply device that is connected with the fluid inlet structure, and the cleaning fluid supply device is configured to supply the cleaning fluid for cleaning the mop member to the cleaning notch. And/or, the base station further includes a dirty fluid collection device that is connected with the fluid discharge structure, and the dirty fluid collection device is configured to collect the cleaning fluid after the base station cleaning the mop member.

Optionally, the cleaning fluid supply device includes a first storage unit and a first power device. The first storage unit is configured to store the cleaning fluid, and the first power device is configured to drive the cleaning fluid to flow to the cleaning notch from the first storage unit. And/or, the dirty fluid collection device includes a second storage unit. The second storage unit is configured to store the cleaning fluid after cleaning the mop member.

Optionally, the cleaning fluid supply device further includes an auxiliary material supply device. The auxiliary material supply device is configured to provide auxiliary material required for cleaning the mop member to the first storage unit or the cleaning notch.

Optionally, the second storage unit is arranged below the cleaning notch and is connected with the cleaning notch. Or, the dirty fluid collection device further includes a second power device. The second power device is configured to pump the cleaning fluid after cleaning the mop member into the second storage unit for the purpose of storage.

Optionally, the base station further includes a fluid level detection device. The fluid detection device is configured to detect a fluid level of the cleaning fluid.

Optionally, the fluid level detection device includes a first conductive element, a second conductive element and a third conductive element. The first conductive element is configured for detecting capacitance value of environment, the second conductive element and the third conductive element are both arranged in the first storage unit and the second storage unit, the second conductive element is configured for detecting capacitance difference caused by a fluid level change of the cleaning fluid, the third conductive element is configured for detecting capacitance value of the cleaning fluid.

The present disclosure also provides a cleaning robot system. The cleaning robot system includes a cleaning robot. The cleaning robot includes a moving device that is configured to drive the cleaning robot to move on the floor surface, and a cleaning device that is configured to clean the floor surface. The cleaning device includes a mop device. The mop device includes a mop unit. The mop unit includes a mop member that is configured to mop the floor surface. The cleaning robot system further includes a base station according to the present disclosure.

Optionally, the cleaning robot system further includes a lifting mechanism. The lifting mechanism is arranged on the cleaning robot and/or the base station. The lifting mechanism is configured to lift a forward end and/or a rearward end of the cleaning robot.

Optionally, the moving device includes a moving wheel, and the cleaning robot includes a suspension device and a chassis. The suspension device is arranged at the moving wheel for elastically connecting the moving wheel and the chassis, to keep the moving wheel in contact with the floor.

Optionally, the mop device further includes a mop drive mechanism. The cleaning robot includes a chassis, the mop drive mechanism is configured to drive the mop member of the mop unit to rotate relative to the chassis, and/or, the mop drive mechanism is configured to drive the mop member of the mop unit to horizontally reciprocate relative to the chassis.

Optionally, the mop device includes one mop unit. The mop drive mechanism is configured to drive the mop member of the one mop unit to rotate and/or horizontally reciprocate relative to the chassis.

Optionally, the mop device includes two mop units. The mop drive mechanism is configured to drive the mop members of the two mop units to rotate around a vertical axis. The mop members of the two mopping units are rotatable in a same direction or in opposite directions around the vertical axis relative to the chassis, or, the mop members of the two mopping units are alternately rotatable in the same direction or in opposite directions around the vertical axis relative to the chassis.

The base station in the present disclosure is arranged to be independent to the cleaning robot, and the mop member cleaning device thereof is capable of automatically cleaning the mop member of the cleaning robot. Thus, the cleaning robot system with the base station is capable of automatically cleaning the mop member, which does not need users to change or clean the mop member frequently. This may free people from the house cleaning, and effectively relieve people of the cleaning burden. Further, a more timely cleaning of the mop member is facilitated, and the ineffective floor cleaning due to the delayed washing or changing of the mop member would be prevented.

Further functions of the present disclosure and its advantages will become apparent from the following detailed description of exemplary embodiments.

BRIEF DESCRIPTION OF THE DRAWINGS

In order to illustrate the technical solution in the embodiments of the present disclosure or the prior art more clearly, brief description would be made below to the drawings required in the embodiments of the present disclosure or the prior art. Obviously, the drawings in the following description are merely some of the embodiments of the present disclosure, and those skilled in the art could obtain other drawings according to the structures shown in the drawings without any creative efforts. In the drawings.

In the aforementioned figures.

Figure 1:
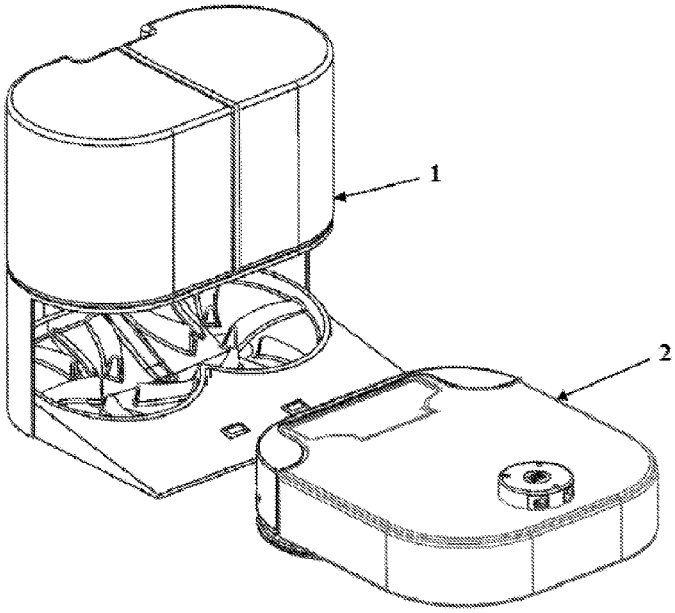
FIG. 1 is an overall structure view of a cleaning robot system according to a first embodiment in the present disclosure.

1, base station;

10, base station body; 101, supporting frame; 102, supporting-frame bottom lid;

11, mop member cleaning device; 111, cleaning notch; 112, protruding portion; 1121, bottom protrusion; 1122, side protrusion; 113, fluid inlet structure; 114, fluid discharge structure; 115, guiding plate; 116, guiding surface; 117, scraping and blocking member; 118, cleaning roller; 119, guiding wheel;

12, cleaning fluid supply device; 121, first storage unit; 1211, bin body; 1212, bin lid; 1213, handle; 1214, buckle; 122, first water pump;

13, dirty fluid collection device; 131, second storage unit; 132, second water pump;

14, charging device; 141, charging element;

151, first conductive element; 152, second conductive element; 153, third conductive element;

2, cleaning robot;

20, housing; 201, upper housing; 2011, upper housing cover; 202, chassis; 2021, lower housing cover; 203, avoiding slot;

21, moving device; 211, moving wheel; 212, spring; 213, supporting member;

22, cleaning device; 221, mop device; 2211, mop unit; 22111, mop member; 22112, platen; 2212, mop drive mechanism; 22121, two-head worm motor; 22121', single-head worm motor; 22122, worm gear; 22123, output shaft; 22124, bearing; 22125, oil seal ring; 2213, mounting chassis; 2214 upper tray; 2215, lower tray; 2216, flexible connection block; 2217, magnetic adsorption member; 2218, horizontal rotating shaft; 2219, scraping and blocking structure; 222, sweeping device;

2221, side brush;

23, rubbish collection device; 231, dust bin; 2311, blocking plate; 2312, scraping blade; 2312', roller brush; 2313, bin body; 2314, bin lid; 2315, handle; 2316, positioning pin; 233, filter net; 233', HEPA paper; 2331', HEPA paper frame; 234, dust removal fan; 235, fan duct; 236, dust suction port; 237, rubbish blocking member;

238, filter frame;

24, lifting mechanism;

25, collision sensing plate; 251, camera; 252, charging contact element;

26, laser radar; 261, radar protecting cover;

27, control device;

28, battery.

DETAILED DESCRIPTION OF THE EMBODIMENTS

The technical solutions in the embodiments according to the present disclosure will be described clearly and completely combined with the drawings. Obviously, the described embodiments are a part of the embodiments of the present disclosure, but not all of them. Based on the embodiments in the present disclosure, all other embodiments obtained by those skilled in the art without creative work shall fall in the scope of protection of the present disclosure.

Techniques, methods, and apparatus known to those skilled in the art will not be discussed in detail. However, where appropriate, the techniques, methods, and apparatus should be considered as part of the present disclosure.

In the present disclosure, it should be understood that the use of the terms "first", "second" and the like to define a component is merely for the distinction between the corresponding components. The meaning is therefore not to be construed as limiting the scope of the present disclosure.

In addition, it should be understood that orientation words such as "forward, backward, up, down, left, right", "transversal, longitudinal, vertical, horizontal" and "top, bottom", etc. are indicated. The orientation or positional relationship is usually defined based on the state in which the cleaning robot system is normally used. The cleaning robot advances in the forward direction, and accordingly, the cleaning robot moves back in the backward direction. The orientation words "inside, outside" refer to inside and outside of the outline of each component.

Figure 58:
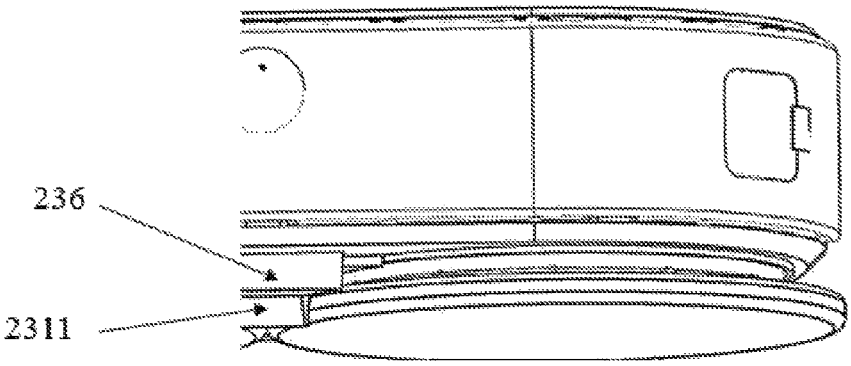
FIG. 58 is a partial view of the bottom of the cleaning robot shown in FIG. 57 from a different angle.

FIGS. 1 to 58 show various embodiments of a cleaning robot system including a base station according to the present disclosure. Referring to FIGS. 1 to 58, the cleaning robot system includes the base station 1 and a cleaning robot 2. The cleaning robot 2 includes a mop member 22111, and the mop member 22111 is configured to mop a floor surface. The base station 1 in the present disclosure is arranged to be independent to the cleaning robot 2. The base station 1 includes a base station body 10 and a mop member cleaning device 11 arranged on the base station body 10. The mop member cleaning device 11 is configured to clean the mop member 22111.

In the present disclosure, the mop member cleaning device 11 of the base station 1 is capable of automatically cleaning the mop member 22111 of the cleaning robot 2, so that the cleaning robot system having the base station 1 is capable of automatically cleaning the mop member 22111 and does not need users to change the mop member 22111 frequently. Therefore, the base station 1 in the present disclosure is not only helpful to free users from the floor cleaning, thereby reducing cleaning burden on users, but also helpful to clean the mop member 22111 in time, so as to ensure a better effect in next cleaning.

In the present disclosure, the base station 1 may clean the mop member 22111 by means of ultrasonic cleaning, dry cleaning, water cleaning, and etc. The water cleaning method is preferable, because it is easier to implement, with lower cost and better cleaning effect. The mop member 22111 retains a certain amount of moisture after the water cleaning, which can be used for mopping directly with no need for manual wetting, thus enhancing the working efficiency of the cleaning robot 2.

In the present disclosure, to enable the base station to provide better cleaning effect, preferably, the mop member cleaning device 11 and the mop member 22111 are arranged to be in motion relative to each other. For example, the mop member cleaning device 11 and the mop member 22111 are arranged to rotate relative to each other; and/or, the mop member cleaning device 11 and the mop member 22111 are arranged to move relative to each other. During the process of the mop member cleaning device 11 cleaning the mop member 22111, the mop member 22111 is pressed against the mop member cleaning device 11 closely to increase the friction between the mop member cleaning device 11 and the mop member 22111, thus the cleanliness of the mop member 22111 can be improved. The relative motion between the mop member cleaning device 11 and the mop member 22111 may be generated by that one of the mop member cleaning device 11 and the mop member 22111 moves, while the other one remains static; or both of the mop member cleaning device 11 and the mop member 22111 move, with different motion directions and/or different motion speeds, that is, when the cleaning device 11 moves the mop member 22111 remains static or when the mop member 22111 moves, the cleaning device 11 remains static.

In the present disclosure, the mop member cleaning device 11 may include a protruding structure, and the protruding structure includes a protruding portion 112. The protruding portion 112 is in contact with the mop member 22111 during the process of the mop member cleaning device 11 cleaning the mop member 22111. The protruding portion 112 can scrape sewage or rubbish off the mop member 22111 during the cleaning process, so as to achieve a more thorough cleaning of the mop member 22111, and prevent the mop member 22111 from remaining excessively moisture after cleaning. In addition, when there is relative motion between the mop member cleaning device 11 and the mop member 22111, a plane friction motion is generated between the protruding portion 112 and the mop member 22111, which increases the frictional force between the mop member cleaning device 11 and the mop member 22111, thereby further improving the cleaning effect of the mop member cleaning device 11 on the mop member 22111.

In order to facilitate the cleaning robot 2 to move into the base station 1, preferably, the base station 1 in the present disclosure further includes a guiding structure defined on the mop member cleaning device 11. The guiding structure is configured to guide the cleaning robot 2 to move into or out of the base station 1, thereby to allow the mop member 22111 to get into or out of the mop member cleaning device 11. Based on this, when the mop member 22111 needs cleaning, the cleaning robot 2 can conveniently move into the base station 1 under the guiding action of the guiding structure, thereby allowing the mop member 22111 to get into the mop member cleaning device 11 for cleaning. And after cleaning the mop member 22111, the cleaning robot 2 can smoothly move out of the base station 1 under the guiding action of the guiding structure, thereby allowing the mop member 22111 to get out of the mop member cleaning device 11. As can be seen, the guiding structure makes it more convenient for the cleaning robot 2 to move into and out of the base station 1, thus improving the working efficiency of the cleaning robot system. The guiding structure may include at least one of a guiding surface, a guiding plate and a guiding wheel.

The present disclosure will be further described combined with various embodiments of the cleaning robot system as shown in FIGS. 1 to 58.

FIGS. 1 to 23 show a first embodiment of a cleaning robot system.

As shown in FIGS. 1 to 23, in the first embodiment, the cleaning robot system includes a cleaning robot 2 and a base station 1 which are defined to be independent to each other. The cleaning robot 2 is configured to automatically clean a floor surface, the ways of cleaning including mopping and sweeping. The base station 1 is configured to charge the cleaning robot 2 and clean the mop member 22111 of the cleaning robot 2. After the mop member 22111 works for a period of time, the cleaning robot 2 needs to be charged and/or the mop member 22111 needs to be cleaned, the cleaning robot 2 can automatically return to the base station 1 for charging and/or for cleaning of the mop member 22111.

FIGS. 6 to 20 show the structure of the first embodiment of the cleaning robot 2. As shown in FIGS. 6 to 20, in the first embodiment, the cleaning robot 2 is a mobile cleaning device, including a housing 20, a moving device 21, a cleaning device 22, a rubbish collection device 23, etc.

Figure 6:
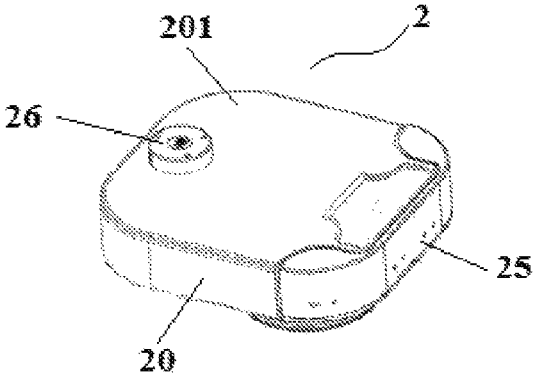
FIG. 6 is a top perspective view of the overall structure of a cleaning robot shown in FIG. 1.
Figure 7:
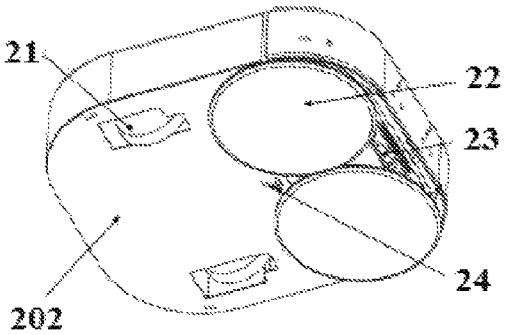
FIG. 7 is a bottom perspective view of the overall structure of a cleaning robot shown in FIG. 1.
Figure 8:
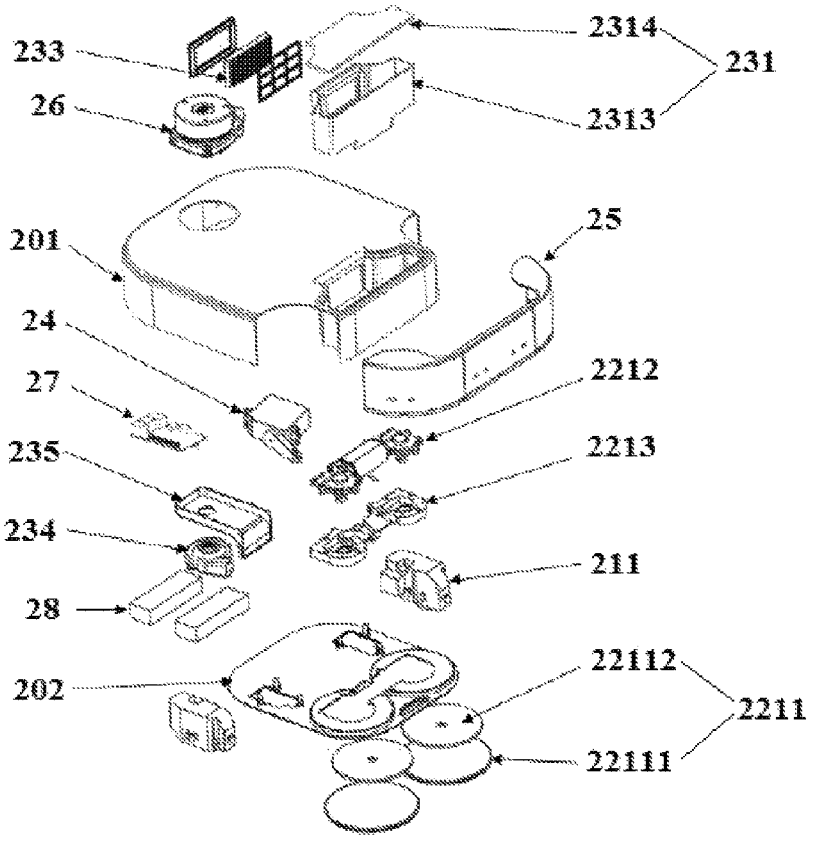
FIG. 8 is an exploded structure view of the cleaning robot shown in FIG. 6.
Figure 9:
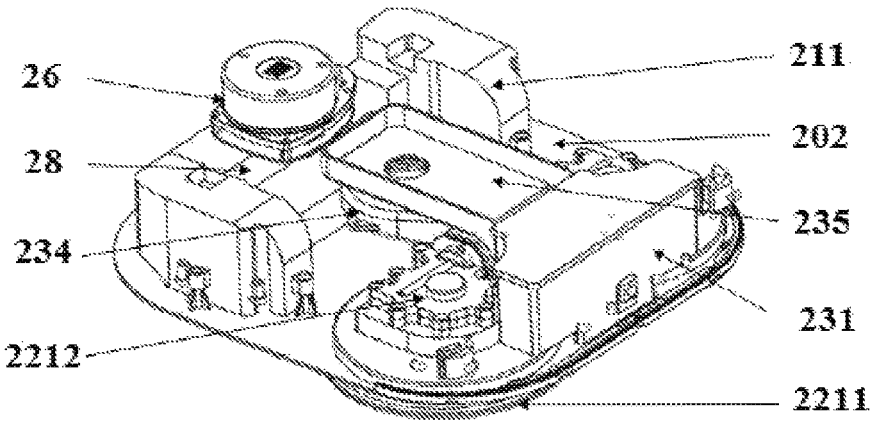
FIG. 9 is a structure view of the cleaning robot shown in FIG. 6 with an upper housing and a processing circuit being removed.

The housing 20 is defined to be a mounting base body for other structural components of the cleaning robot 2, and provides supporting for the other structural components. As shown in FIGS. 6 to 8, the housing 20 in this embodiment includes an upper housing 201 and a chassis 202, between which there is a space. The moving device 21, the cleaning device 22, and the rubbish collection device 23 are all mounted on the chassis 202. The upper housing 201 is covered above the chassis 202, in order to protect the structural components in the space between the upper housing 201 and the chassis 202, and enable overall structure to be integrity and beauty.

The moving device 21 is used for driving the cleaning robot 2 to move on the floor surface. As shown in FIGS. 7 to 8, the moving device 21 in this embodiment includes two moving wheels 211. The two moving wheels 211 are symmetrically disposed on the left and right sides of the chassis 2. The rotations of the moving wheels 211 enable to drive the cleaning robot 2 forward or backward, and the differential steering of the cleaning robot 2 can be performed by driving the two moving wheels 211 at different rotation speeds.

The cleaning device 22 is used for cleaning the floor surface. In this embodiment, the cleaning device 22 includes a mop device 221, and the mop device 221 includes two mop units 2211. Each of the mop units 2211 includes a platen 22112 and a mop member 22111. The mop member 22111 is mounted on a bottom surface of the platen 22112 for mopping the floor surface.

The mop member 22111 may be various members capable of mopping the floor, such as a mop cloth (or referred to a rag) or a sponge. The mop member 22111 in this embodiment uses the mop cloth. And preferably, the mop member 22111 is detachably connected with the platen 22112. For example, in this embodiment, the mop member 22111 is affixed to the bottom surface of the platen 22112 with a hook-and-loop fastener, which facilitates the disassembly and replacement of the mop member 22111.

In this embodiment, the mop member 22111 and the platen 22112 are both circular. In other embodiments, the two may have other shapes such as rectangle. The two being arranged in circular shapes is more convenient for the mop unit 2211 to clean a narrow area such as a corner inside a house, and beneficial for the following rotation arrangement.

In order to solve the poor mopping effect of the existing cleaning robot, referring to FIGS. 7 to 12 and FIG. 20, the mop unit 2211 in this embodiment is arranged to rotate relative to the chassis 202. In this way, during the mopping process, the relative motions between the mop member 22111 and the floor include not only the relative motion caused by the movement of the cleaning robot 2 relative to the floor, but also the relative motion caused by the rotation of the mop member 22111 relative to the floor, which enhances the mopping force of the mop member 22111 and increases the number of times of mopping, thereby to improve the mopping effect of cleaning the floor, especially facilitating to clean stubborn stains stuck to the floor surface more thoroughly. In addition, it is convenient for the mop member 22111 to sweep up large particulates and dust on the floor surface by its rotation, that is, the mop member 22111 also has the function of sweeping, which enables the cleaning robot 2 in the first embodiment to integrate the functions of sweeping and mopping with no need for an additional sweeping device 222, thus better cleaning effect and multi-function can be achieved. Beyond that, the cleaning robot 2 is simpler in structure and smaller in size to realize miniaturization and flexibility.

The mop unit 2211 rotates relative to the chassis 202 around a horizontal axis or a vertical axis. In this embodiment, the rotation around the vertical axis is preferable, because the mop member 22111 rotated around the vertical axis helps to achieve a better effect on mopping and sweeping. On condition that the mop device 221 includes at least two mop units 2211, the at least two mop units 2211 may be driven to rotate around the vertical axis, wherein the at least two mop units 2211 may be driven to rotate around the vertical axis in a same direction or in different directions by the mop drive mechanism 2212, or the at least two mop units 2211 are driven to alternately rotate around the vertical axis in the same direction and in different directions, that is, the at least two mop units 221 are rotated in the same direction for a certain period of time, then are changed to rotate in opposite directions for another period of time. By the arrangement that the two mop units 2211 are rotated around the vertical axis in opposite directions, the mop device 221 can gather rubbish to the place between the two of the mop units 2211, thereby to achieve a better effect on rubbish gathering.

Figure 20:
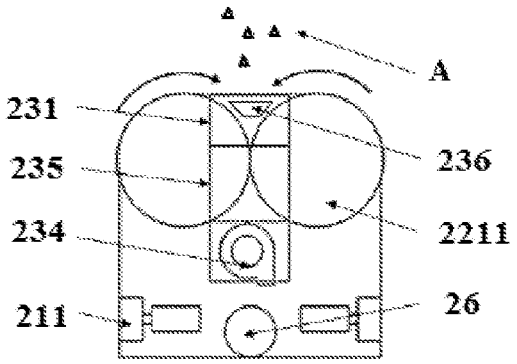
FIG. 20 illustrates the positional relationship between the mop device and the rubbish collection device of the cleaning robot shown in FIG. 6.

As shown in FIG. 20, in this embodiment, the two mop units 2211 can gather the swept rubbish to the middle of them by rotating around the vertical axis in opposite directions, so as to realize the function of rubbish collection. Based on this, in this embodiment, the mop device 221 can be cooperated with the rubbish collection device 23 to achieve a better cleaning effect, which will be detailed later. In addition, when the two mop units 2211 are rotated around the vertical axis in opposite directions, the directions of frictional forces generated by the two rotated mopping units 2211 are opposite to each other, thus the frictional forces counteract each other, which avoids unbalanced walking of the cleaning robot 2. In summary, the cleaning robot 2 can move more smoothly.

In order to realize the rotations of the mop units 2211 relative to the floor, the mopping device 221 in this embodiment further includes a mop drive mechanism 2212. The mop drive mechanism 2212 is connected with the mop units 2211 and the chassis 202, and configured to drive the mop units 2211 to rotate relative to the chassis 202, that is, to drive the mop unit 2211 to rotate relative to the floor. Specifically, as shown in FIGS. 8 to 12, in this embodiment, the mop drive mechanism 2212 includes a worm gear and worm mechanism which can transmit the torques in opposite directions to the mop units 2211, the mop drive mechanism 2212 includes a worm motor, two worm gears 22122, and two output shafts 22123. The worm motor is connected with a worm, each of the worm gears 22122 is engaged with the worm to form the worm gear and worm mechanism. The worm gears 22122 are drivingly connected between the worm motor and the output shafts 22123, and each of the worm gears 22122 is connected corresponding to each of the output shafts 22123. The output shafts 22123 are drivingly connected between the worm gears 22122 and the mop units 2211, and each of the output shafts 22123 is connected corresponding to each of the mop units 2211. The worm motor drives the worm gears 22122 to rotate to provide the output shafts 22123 with torques in opposite directions, and the output shafts 22123 drive the mop units 2211 to rotate to transmit the torques in opposite directions to the mop units 2211. The two output shafts 22123 are vertically arranged, the worm motor drives the mop units 2211 to rotate around their own corresponding output shafts 22123 to realize the rotation of the two mop units 2211 around the vertical axis in opposite directions.

Figure 12:
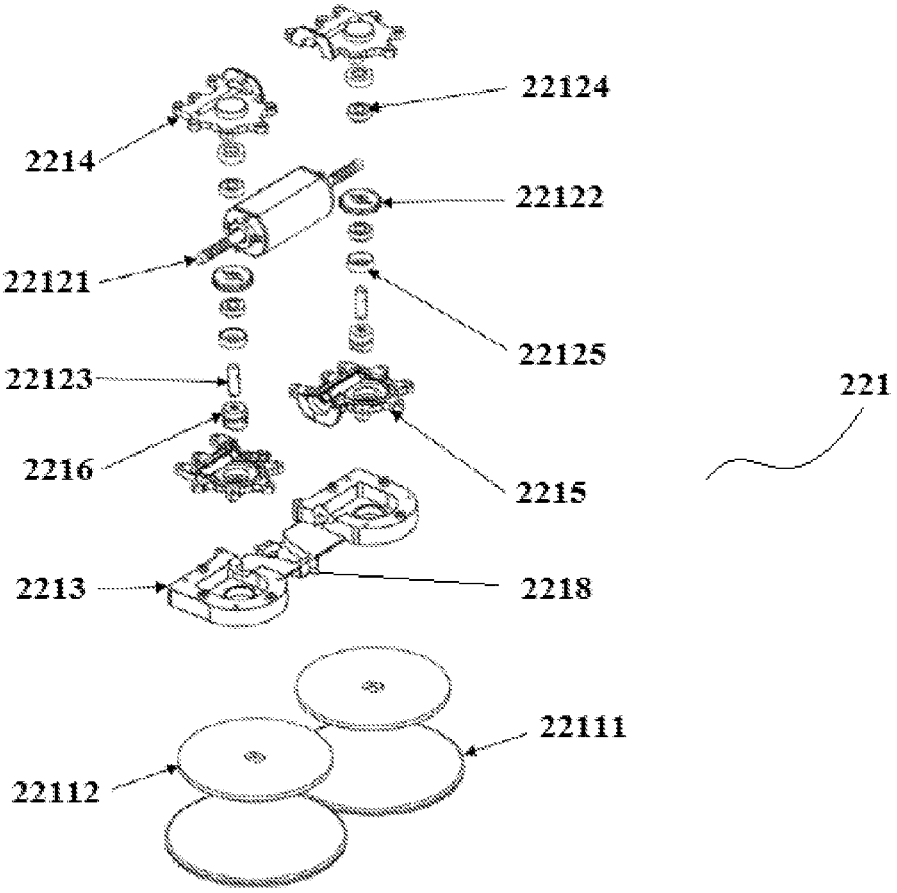
FIG. 12 is an exploded structure view of the mop device show in FIG. 11.

More specifically, as shown in FIG. 12, in this embodiment, the worm motor is a double-head worm motor 22121. The double-head worm motor 22121 is used as a worm power mechanism for outputting the torques. The two worm gears 22122 are respectively engaged with the double-head worm motor 22121 and the two worm gears 22122 are respectively engaged with the two worms on the two sides of the double-head worm motor 22121. The double-head worm motor 22121 provides torques in opposite directions, and the worm motor drives the output shafts 22123 to rotate in opposite directions via the worm gears 22122 to drive the mop units 2211 to rotate around vertical axis in opposite directions. In this way, the structure is simple and tight, and transmission efficiency is high.

Figure 11:
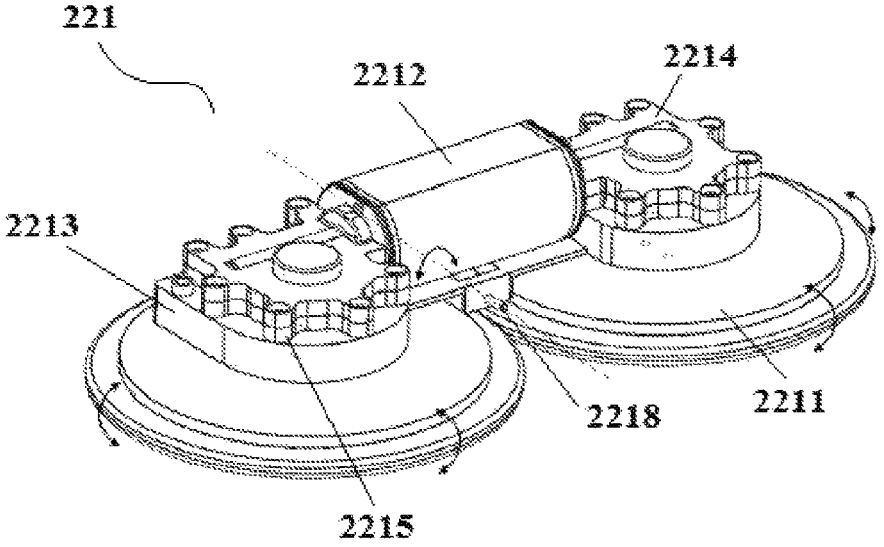
FIG. 11 is an overall structure view of a mop device of the cleaning robot shown in FIG. 6.

In addition, as shown in FIGS. 11 and 12, the mop device 221 in this embodiment further includes a mounting chassis 2213, an upper tray 2214, and a lower tray 2215. The mop drive mechanism 2212 is mounted on the chassis 202 by the mounting chassis 2213, the upper tray 2214, and the lower tray 2215. The upper tray 2214 and the lower tray 2215 are fastened to each other to form a hollow space. The components of the mop drive mechanism 2212 are located in the hollow space for a cooperative transmission, the mounting chassis 2213 is arranged on the chassis 202, and the lower tray 2215 is mounted on the mounting chassis 2213, so as to allow the mop drive mechanism 2212 to be mounted on the chassis 202. And the mop drive mechanism 2212 in this embodiment further includes a bearing 22124 and an oil seal ring 22125. The bearing 22124 and the oil seal ring 22125 are arranged between the output shaft 22123 and the worm gear 22122 to achieve smoother transmission.

In this embodiment, the mop units 2211 are swingingly connected to the chassis 202 of the cleaning robot 2. Based on this, the mop member 22111 of the mop unit 2211 can be in contact with the floor surface at all times by swinging relative to the chassis 202 in response to the unevenness of the floor surface, so as to ensure that the two mop members 22111 in this embodiment are in close contact with the floor surface at all times. In this way, the area having an uneven floor surface can be effectively prevented from failing to be mopped, thereby to enable a more thorough and efficient cleaning on various kinds of floor surface. Besides, the cleaning robot 2 is capable of cleaning more complex and diverse kinds of floor surface, thus effectively expanding the cleaning scope thereof.

Specifically, the mop units 2211 in this embodiment not only enable to swing around the vertical axis, but also swing around the horizontal axis, so that the mop members 22111 have a plurality of degrees of freedom of swinging, which facilitates the mop members 22111 to be in contact with the floor surface at all times and more adaptive to the uneven floor surface, thus achieving a better effect on floor cleaning.

Figure 13:
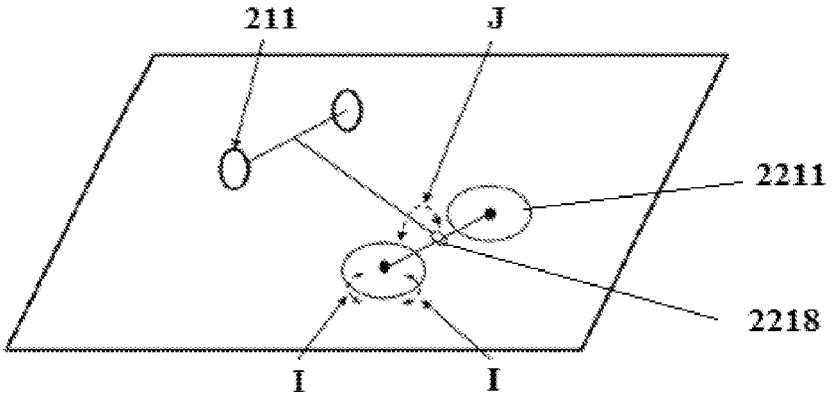
FIG. 13 illustrates degrees of freedom of the mop member shown in FIG. 12 swinging under the action of a flexible connection block and a horizontal rotating shaft.
Figure 14:
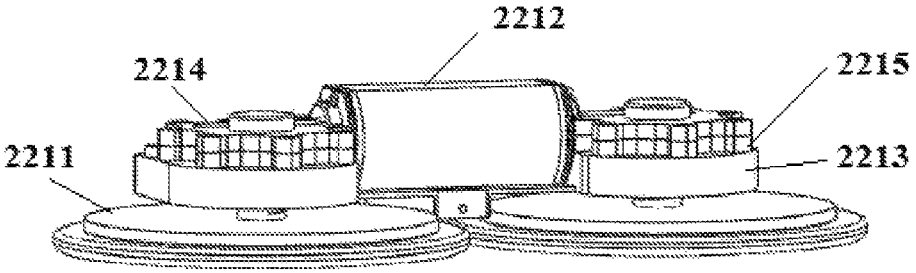
FIG. 14 is a structure view of the mop device shown in FIG. 11 with a horizontal rotating shaft being removed.
Figure 15:
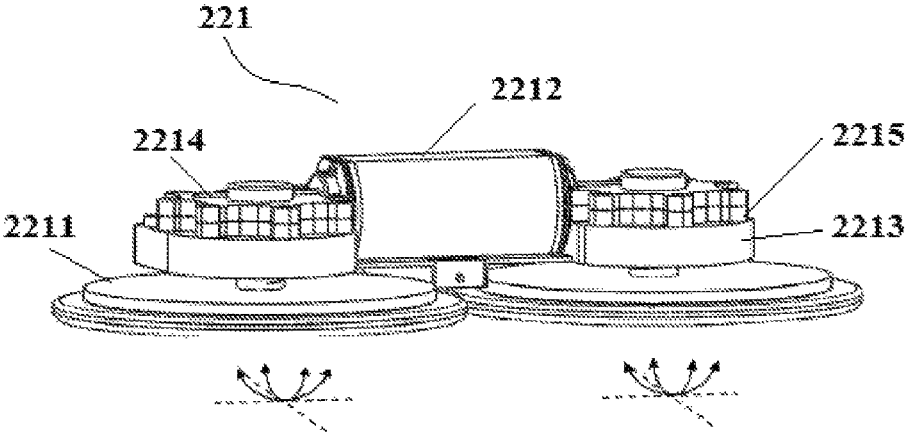
FIG. 15 illustrates degrees of freedom of the mop member shown in FIG. 14 swinging under the action of the flexible connection block.

In order to realize the swinging of the mop unit 2211 around the vertical axis, in this embodiment, as shown in FIG. 12, flexible connection blocks 2216 are arranged between the mop units 2211 and the output shafts 22123 of the mop drive mechanism 2212, to connect the mop unit 2211 and the output shaft 2213. The flexible connection blocks 2216 may be detachably connected with the mop units 2211 and/or the mop drive mechanism 2212. The flexible connection blocks 2216, as flexible connecting structures, can be freely deformed. Therefore, when the cleaning robot 2 encounters an uneven floor surface, the flexible connection blocks 2216 can be deformed when the mop members 22111 are subjected to the ground pressure, to drive the mop units 2211 to swing relative to the chassis 202 (namely relative to the floor) around the vertical output shafts 22123, thereby keeping in contact with the floor. In addition, as shown in FIGS. 11, 13 and 15, the flexible connection blocks 2216 provide an adjustment degree of freedom of swinging for the corresponding mop units 2211 (namely, the first degree of freedom of swing I in FIG. 13), thus the mop units 2211 have more ways of swinging to be more flexible to adapt to the uneven floor surface.

As can be seen, the mop units 2211 enable to swing around the vertical axis by the deformation of material of the flexible connection block 2216 connected between the output shaft 22123 and the mop member 2211, and the swinging angle of the mop unit 2211 can be flexibly adjusted in accordance with the uneven floor surface, which allows the mop member 22111 in close contact with the floor surface at all times during the mopping process, thus further improving the mopping effect.

It should be noted that the flexible connecting structure applied in this embodiment is not limited to the flexible connection block 2216. Other flexible connecting structures capable for realizing the swinging of the mop unit 2211 by the deformation of material itself are also applicable.

In order to realize the swinging of the mop unit 2211 around the horizontal axis, in this embodiment, a horizontal rotating shaft 2218 is arranged between the mop device 221 and the chassis 202, to connect the mop device 221 and the chassis 202. Specifically, as shown in FIGS. 12 and 13, the horizontal rotating shaft 2218 in this embodiment is connected between the chassis 202 and the middle of the drive shaft that is connected between the two mop units 2211 of the mop device 221. The horizontal rotating shaft 2218 provides a degree of freedom of horizontal rotation (namely a second degree of freedom of swing J as shown in FIG. 13) for each of the mop units 2211, so that each of the mop units 2211 enables to swing around the horizontal rotating shaft 2218 in response to the unevenness of the floor surface, thereby enabling the mop member 22111 to be in contact with the floor.

As can be seen, by simultaneously arranging the flexible connection block 2216 and the horizontal rotating shaft 2218 in this embodiment, the mop member 22111 is allowed to have a plurality of degrees of freedom of swinging, thereby to be more flexible to adapt to the uneven floor surface. In this way, the mop members 22111 can keep close contact with the floor surface when the cleaning robot 2 encounters an uneven floor surface, thereby to clean the floor more cleanly.

In another aspect, referring to FIG. 13, in this embodiment, since the mop device 221 and the chassis 202 are provided with the horizontal rotating shaft 2218 therebetween, the contact of the mop device 221 with the floor surface is equivalent to a fulcrum, that is, there is one fulcrum when the mop device 221 is in contact with the floor surface. At the same time, there are two fulcrums when the two moving wheels 211 are in contact with the floor surface. Thus, as a whole, a three-point support is formed between the cleaning robot 2 in this embodiment and the floor, which enhances the overall operational stability of the cleaning robot 2 and further improves the cleaning effect.

It should be noted that the way to realize the swinging of the mop units 221 in response with the unevenness of the floor surface is not limited to the above-described embodiment (namely the way shown in FIG. 13). Three alternative embodiments are provided below.

Figure 16:
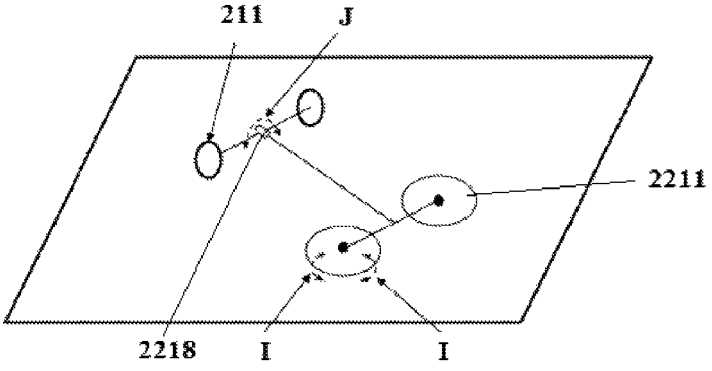
FIG. 16 illustrates a first modified embodiment of FIG. 13.

As an alternative embodiment, as shown in FIG. 16, the location of the horizontal rotating shaft 2218 can be changed, the horizontal rotating shaft 2218 is arranged between the moving device 21 and the chassis 202 to connect the moving device 21 and the chassis 202. Based on this, the moving device 21 and the chassis 202 are connected by the rotating shaft. The moving device 21 as a whole provides one fulcrum for the cleaning robot 2. And each of the flexible connection blocks 2216 of the mop device 221 provides two adjustment degrees of freedom of swinging for each of the mop units 2211, so that there are two fulcrums in contact with the floor, that is, the mop device 221 provides two fulcrums for the cleaning robot 2. As can be seen, this alternative embodiment also allows the mop member 22111 in contact with the floor surface at all times, and enables a three-point support between the cleaning robot 2 and the floor surface. The three fulcrums in this alternative embodiment include two front fulcrums and one rear fulcrum, while the three fulcrums as shown in FIG. 13 include one front fulcrum and two rear fulcrums.

Figure 17:
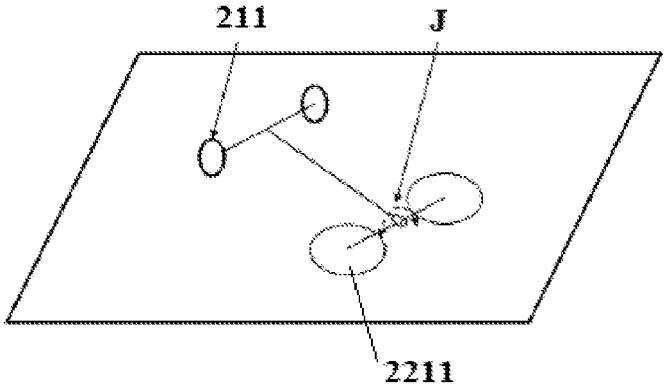
FIG. 17 illustrates a second modified embodiment of FIG. 13.
Figure 18:
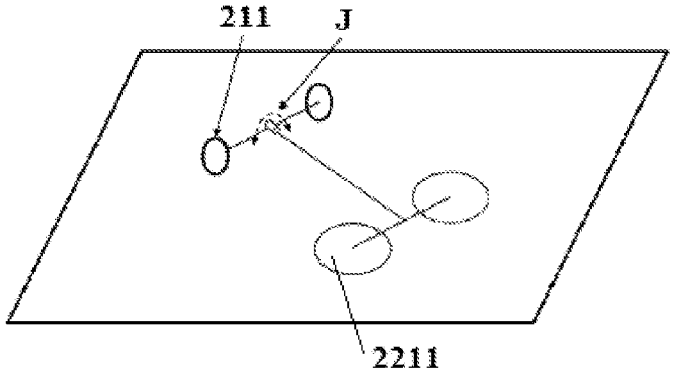
FIG. 18 illustrates a third modified embodiment of FIG. 13.

As the other two alternative embodiments, referring to FIGS. 17 and 18, in these embodiments, without arranging the aforementioned flexible connection block 2216, the horizontal rotating shaft 2218 is arranged between the mop device 221 and the chassis 202, or the horizontal rotating shaft 2218 is arranged between the moving device 221 and the chassis 202. In these two alternatives, although the mopping performance when the mop members 22111 are in close contact with the floor surface is not equal as that when both of the mop members 22111 swing around the vertical axis, the mop member 22111 and/or the moving device 21 can still swing relative to the chassis 202 to form the aforementioned three-point support, and the structure is simpler and the cost is lower.

The rubbish collection device 23 is configured to collect rubbish gathered by the cleaning device 22, and includes a collection port for connecting the inside and the outside of the rubbish collection device 23 thereof. The rubbish gathered by the cleaning device 22 gets into the rubbish collection device 23 through the collection port.

As shown in FIGS. 7 to 9 and 19, in this embodiment, the rubbish collection device 23 includes a dust bin 231, a filter net 233, a dust removal fan 234, a fan duct 235, and a dust suction port 236. The dust bin 231 includes a bin body 2313 and a bin lid 2314. The bin lid 2314 is covered at the top opening of the bin body 2313. The dust suction port 236 is disposed at a lower portion of the dust bin 231 with an opening facing the floor surface, through which the rubbish can get into the dust bin 231. The dust removal fan 234 is connected with the inside of the dust bin 231 through the fan duct 235, the rubbish such as dust gets into the dust bin 231 through the dust suction port 236 under the action of the dust removal fan 234. The filter net 233 is disposed on one side of the dust bin 231 and located on a path where the dust removal fan 234 is connected with the dust bin 231 (the filter net 233 is specifically disposed on a path where the fan duct 235 is connected with the dust bin 231 in FIG. 19), so that the rubbish in the wind is filtered by the filter net 233 to remain in the dust bin 231, whereas the wind is drawn away by the dust removal fan 234.

Figure 19:
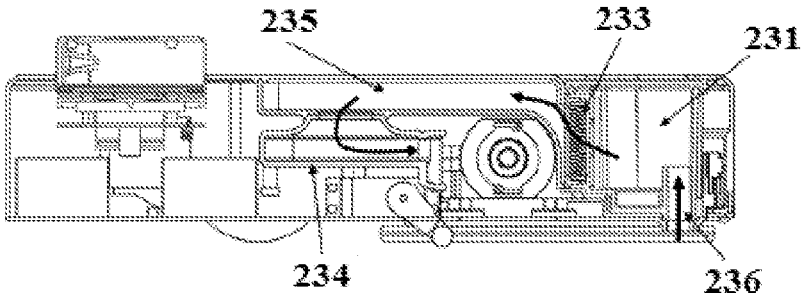
FIG. 19 illustrates an air passage of the rubbish collection device of the cleaning robot shown in FIG. 6.

As shown in FIG. 19, the outlet of the dust removal fan 234 faces the double-head worm motor 22121, so that the wind from the dust removal fan 234 is directly blown to the double-head worm motor 22121 to cool the double-head worm motor 22121, thereby ensuring the working performance of the double-head worm motor 22121, and prolonging the operation life of the double-head worm motor 22121.

In an modified embodiment, the mop drive mechanism is arranged on two sides of the dust suction device, so that the dust suction device as a whole extends along the front-rear direction of the cleaning robot 2. For example, the double-head worm motor 22121 may be replaced with two motors, and the two motors output power via the worm gear and worm mechanism or a gear wheel mechanism. In other words, the gear wheel mechanism can transmit the torques in opposite directions to the mop units 2211, which functions the same as the worm gear and worm mechanism. In this way, it is convenient to respectively arrange the two motors on two sides of the dust suction device, to avoid the motor shaft from crossing through and blocking the dust suction device, which allows the air passage of the dust suction device smoother, reduces the air inlet resistance of the dust suction device, and increases the air flow rate of the dust suction device. As such, the dust suction effect of the dust suction device is improved.

In this embodiment, when the rubbish collection device 23 is in operation, the dust removal fan 234 drives wind to draw the rubbish into the inside of the bin body 2313 through the dust suction port 236. The rubbish is blocked by the filter net 233, whereas the wind enters the fan duct 235 through the filter net 233, to flow toward the dust removal fan 234, and finally is drawn by the dust removal fan 234.

As can be seen, the rubbish collection device 23 in this embodiment is a dust suction device, and the dust suction port 236 serves as a collection port. In this embodiment, under the suction force of the dust suction device, not only more rubbish can be gathered by the cleaning device 22 more thoroughly and quickly, reducing the residual rubbish on the floor, but also larger particulates can be suck into the inside of the rubbish collection device 23. Thus, using the dust suction device as the rubbish collection device 23 is advantageous for a better effect on floor cleaning.

Figure 36:
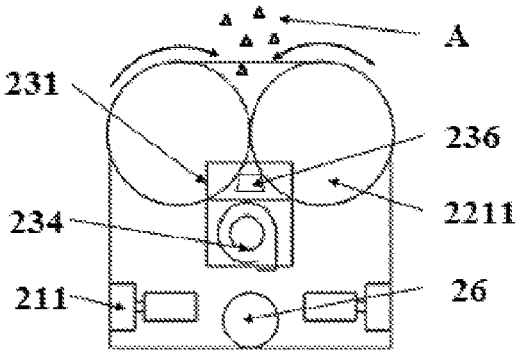
FIG. 36 illustrates a variant of the positional relationship between the suction port and the mop device according to the first embodiment and the second embodiment.

In addition, as described above, in this embodiment, the rubbish can be gathered between the two of the mop units 2211 by the two of the mop units 2211 that are rotated around the vertical axis in opposite directions. In order to collect rubbish more conveniently and efficiently, as shown in FIGS. 7 and 20, in this embodiment, the dust suction port 236 is disposed at the middle of the two of the mop units 2211 of the mop device 221, so that the dust suction port 236 is located between the two mop units 2211 and on a path where the rubbish is gathered, which allows the rubbish collection device 23 to collect the rubbish more fully, thereby realizing a better effect in rubbish collection. The dust suction port 236 may be disposed at the middle of the rear of the two of the mop units 2211, or at the middle of the front of the two of the mop units 2211. On condition that the dust suction port 236 is disposed at the middle of the rear of the two of the mop units 2211, as shown in FIG. 36, since the rubbish is gathered by the rubbish collection device 23 after it is gathered in a smaller area, so that the dust suction port 236 can be designed relatively smaller. And the smaller the suction port 236 is, the greater the suction force is, thus more effective collection can be achieved. And on condition that the dust suction port 236 is disposed at the middle of the front of the two mop units 2211, as shown in FIGS. 7 and 20, the rubbish is collected before being mopped, so that the rubbish can be collected without being wet by the mop member 22111. The unwetted rubbish is more easier to be collected because its adhesion to the ground is weak. On condition that the dust suction port 236 is disposed at the middle of the front of the two of the mop units 2211 rotated around the vertical axis in opposite directions, it is less difficult to collect the rubbish. In this way, the dust collecting device only needs to provide a relatively smaller suction force to collect rubbish, and the problem that the rubbish such as hair is difficult to collect due to excessive moisture can be avoided, thereby making it easier and more thorough to collect rubbish.

Based on the mop device 221 and the rubbish collection device 23 described above, the cleaning robot 2 in this embodiment is allowed to provide a higher quality floor cleaning. In operation, the mop drive mechanism 2212 drives the two of the mop members 2111 in contact with the floor surface to rotate around the vertical axis in opposite directions to mop the stubborn stain adhered to the floor, and gather the rubbish to the middle of the two of the mop members 2111 for further collection by the rubbish collection device 23.

Figure 57:
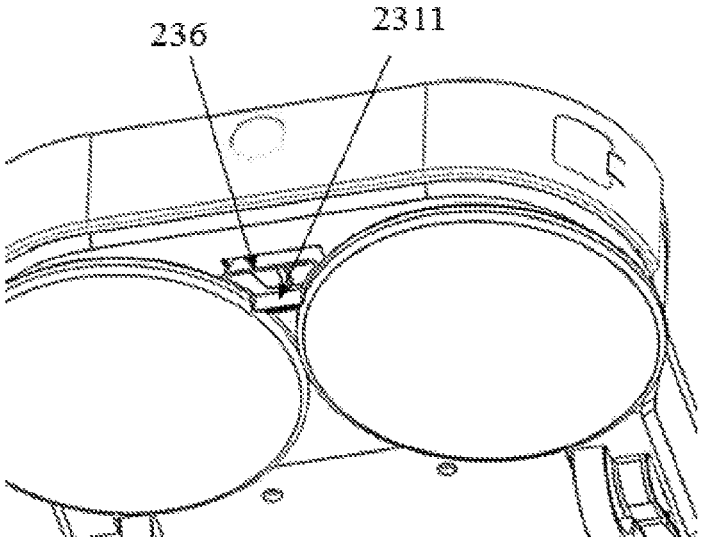
FIG. 57 is a partial enlarged view of the bottom of the cleaning robot based on a modified embodiment of the first embodiment according to the present disclosure.

In addition, referring to FIGS. 57 and 58, in an improved embodiment of this embodiment, the rubbish collection device 23 further includes a blocking plate 2311. The blocking plate 2311 extends obliquely downward to the ground from the collection port (namely the suction port 236 in this embodiment) of the rubbish collection device 23. Based on this, the blocking plate 2311 can block the rubbish gathered to the position thereof, so as to prevent the rubbish cleaned by the cleaning device 22 from spreading out of the range that the collection port (the suction port 236) can collect, which facilitates the rubbish collection of the rubbish collection device 23, and also avoids a secondary pollution to the floor after cleaning. In particular, when the mop members 22111 are rotated relative to the chassis 202 of the cleaning robot 2 around the vertical axis for cleaning purpose, the blocking plate 2311 can prevent the gathered rubbish from being carried away from the collection port (the suction port 236) by the mop members 22111.

In this embodiment, the rubbish collection device 23 may be configured to not work, while the mop device 221 is configured to work; or alternatively, the mop device 221 is replaced with the sweeping device 222 for sweeping the rubbish on floor, for example, a roller brush, so that the sweeping device 222 can be cooperated with the rubbish collection device 23 to implement a separate sweeping function. Because the mop device 221 in this embodiment is detachably connected with the mop drive mechanism 2212, it is convenient to realize a switching of the cleaning mode by the replacement of the mop device 221 and the sweeping device 222. In addition, the cleaning robot 2 has the functions of dry-mopping and wet-mopping by the replacement of the wet mop members 22111 and the dry mop members 22111, the cleaning robot 2 in this embodiment can be used for dry mopping. Similarly, because the mop members 22111 in this embodiment are detachably connected with the platen 22112, it is also convenient to realize a quick switching of the cleaning mode by the replacement of the dry mop members 22111 and the wet mop members 22111.

In addition, as shown in FIGS. 6 and 8 to 10, in this embodiment, the cleaning robot 2 further includes a collision sensing plate 25, a laser radar 26, a control device 27, a battery 28, and a man-machine interaction device such as a button, a screen. The collision sensing plate 25 is configured to prevent the cleaning robot 2 from colliding with an obstacle. In this embodiment, the collision sensing plate 25 is arranged at the front end of the housing 20. The laser radar 26 is configured for map scanning, to realize the mapping and localization of the cleaning robot 2. In this embodiment, the laser radar 26 is embedded in the rear of the upper housing 201. The battery 28 is configured to supply electric power to the cleaning robot 2. The control device 27 is configured to control various operations of the cleaning robot 2, such as, sensor signal collection, motor drive control, battery management, navigation and localization, map generation, intelligent obstacle avoidance, and cleaning path planning.

Further, in order to facilitate the cleaning robot 2 to cross obstacles and move into/out of the base station 1, the cleaning robot 2 in this embodiment further includes a lifting mechanism 24. The lifting mechanism 24 is configured to lift the front end and/or the rear end of the cleaning robot 2, which provides a lifting force for the cleaning robot 2. In this manner, the cleaning robot 2 can conveniently cross an obstacle with a certain height (for example, a door threshold) while moving on the floor, thereby improving the ability of crossing obstacles and expanding the cleaning range thereof. In addition, the cleaning robot 2 can move into and out of the base station 1 that has the mop member cleaning device 11 with a certain height more conveniently.

Figure 10:
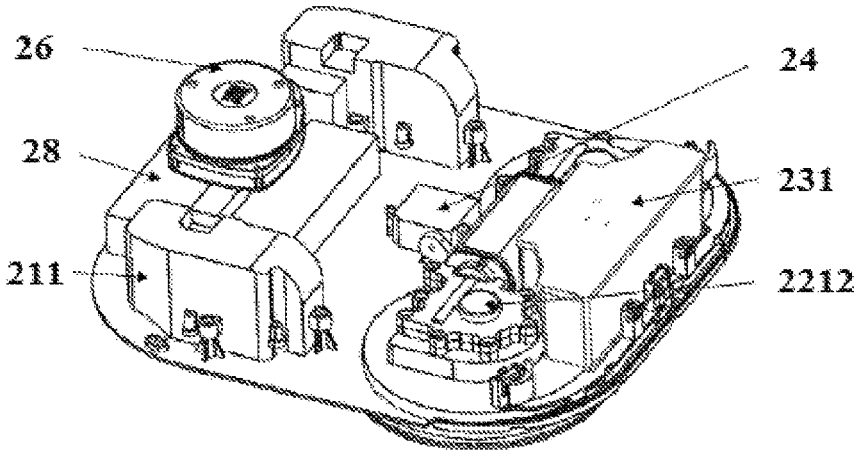
FIG. 10 is a structure view of the cleaning robot shown in FIG. 9 with a dust removal fan and a fan duct being removed.
Figure 21:
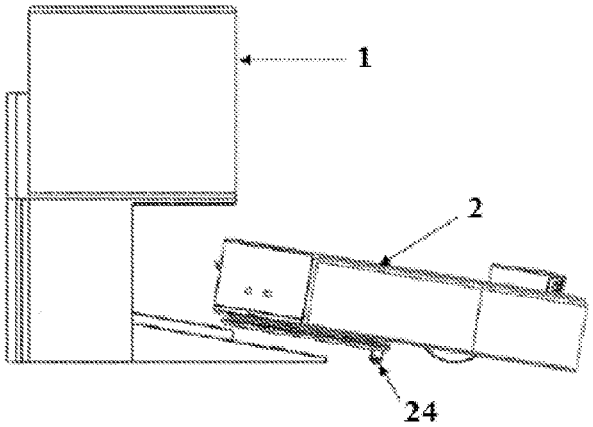
FIG. 21 is a process view in which the cleaning robot according to the first embodiment shown in FIG. 1 gets in the base station under the action of the lifting mechanism.
Figure 22:
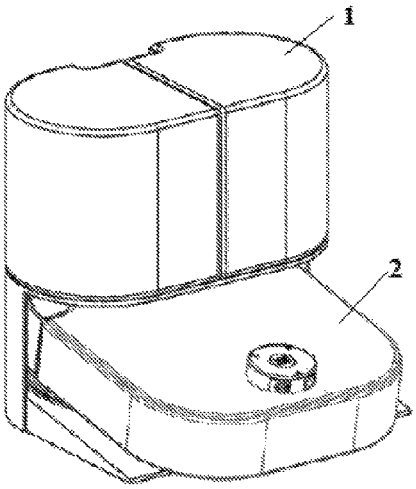
FIG. 22 illustrates a matching state of the cleaning robot according to the first embodiment shown in FIG. 1 with the base station after the cleaning robot getting in the base station.

Specifically, as shown in FIGS. 7, 8, and 10, in this embodiment, the lifting mechanism 24 is arranged on the chassis 202 of the cleaning robot 2, and located at a front position of the chassis 202. The lifting mechanism 24 includes a swing arm which can swing upward and downward. After the swing arm swings downward, it sticks out from the chassis 202 and is supported on a bearing surface (for example, the floor surface), so as to raise the front end of the cleaning robot 2. And after the swing arm swings upward, it takes back, the front end of the cleaning robot 2 is not lifted by the swing arm, so that the front end of the cleaning robot 2 is lowered. Based on this, as shown in FIGS. 21 and 22, during the process of the cleaning robot 2 crossing obstacles or moving into the base station 1, the lifting mechanism 24 can raise the front end of the cleaning robot 2, to actively lift the height of the forward end of the cleaning robot 2, which facilitates the cleaning robot 2 to quickly cross the obstacles, or quickly move into the base station 1, thereby allowing the mop members 22111 to successfully get into the mop member cleaning device 11.

Those skilled in the art should understand that the lifting mechanism 24 is not limited to being disposed on the chassis 202, it may also be disposed on the base station 1. Or alternatively, one lifting mechanism 24 is disposed on the base station 1, and one is disposed on the chassis 202. And on condition that the lifting mechanism 24 is disposed on the chassis 202, the lifting mechanism 24 is not limited to being disposed at the front of the chassis 202, it may also be disposed at the rear of the chassis 202, so as to raise the rear end of the cleaning robot 2.

Figure 50:
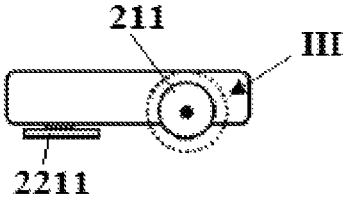
FIG. 50 is a structure view of the cleaning robot provided with a suspension device at the wheel.
Figure 51:
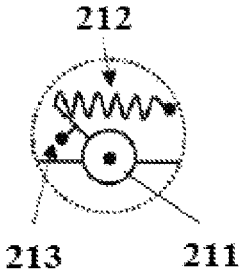
FIG. 51 is a partial enlarged view of III shown in FIG. 50.
Figure 52:
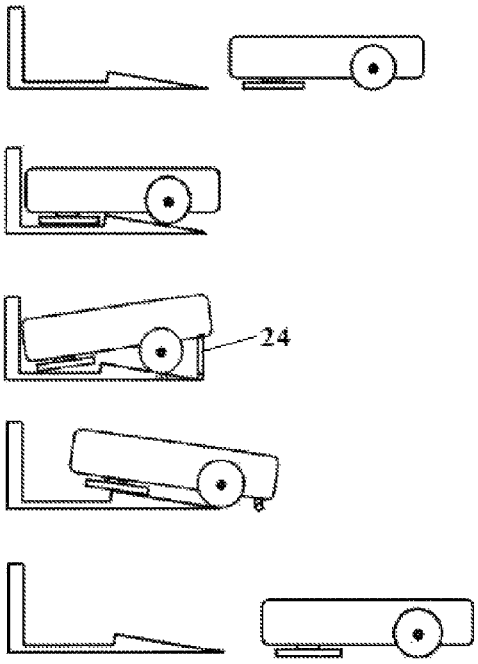
FIG. 52 illustrates a process of the cleaning robot getting in and out the base station based on the lifting mechanism and the suspension device shown in FIG. 50.

FIGS. 50 to 52 show an alternative embodiment in which the lifting mechanism 24 is disposed at the rear of the chassis 202. As shown in FIGS. 50 to 52, in this alternative embodiment, the lifting mechanism 24 is disposed at the rear of the chassis 202. In this manner, as shown in FIG. 52, when the cleaning robot 2 needs to move into the base station 1, without the help of the lifting mechanism 24, the cleaning robot 2 can directly move into the base station 1 under the action of its own driving force and the guiding action of the guiding structure (such as the inclined guiding surface 116 shown in FIG. 52) of the base station 1, thereby allowing the mop members 22111 to get in the mop member cleaning device 11. After the cleaning of the mop members 22111 is finished and the cleaning robot 2 needs to move out of the base station 1, the lifting mechanism 24 raises the rear end of the cleaning robot 2, to make the rear edge of the mop members 22111 higher than the edge of the mop member cleaning device 11, thereby allowing the cleaning robot 2 to move out of the base station 1. And in this alternative embodiment, preferably, a suspension device is disposed at the moving wheels 211. The suspension device is configured for maintaining an elastic connection between the moving wheels 211 and the chassis 202, to allow the moving wheels 211 to be in contact with the floor at all times. As such, when the lifting mechanism 24 raises the rear end of the cleaning robot 2, the moving wheels 211 can be in close contact with the floor under the action of the suspension device, to provide a frictional force to the cleaning robot 2. Thus, the suspension device facilitates the cleaning robot 2 to move out of the base station 1 more efficiently.

Specifically, as shown in FIGS. 50 and 51, in the alternative embodiment, the suspension device includes a spring 212 and a supporting member 213. The spring 212 is horizontally arranged. The supporting member 213 is obliquely connected between the spring 212 and the moving wheel 211, and a portion between its two ends that are respectively connected with the spring 212 and the moving wheel 211 is arranged to rotate relative to the housing 20 of the cleaning robot 2. Based on this, the suspension device not only enables the moving wheel 211 to be in contact with the floor surface, but also assists the lifting mechanism 24 to raise the rear end of the cleaning robot 2 with the elastic force of the spring 212. In this case, the lifting mechanism 24 only needs to apply a small lifting force to raise the rear end of the cleaning robot 2, which allows the lifting mechanism 24 to use a small motor, thereby reducing cost and saving installation space.

In addition, the suspension device and the lifting mechanism 24 may be provided independently of each other without the participation of each other. The ability of crossing obstacles of the cleaning robot 2 can be improved on condition that the suspension device is separately provided, because the suspension device can allow the moving wheel 211 to be in contact with the floor surface at all times.

FIGS. 2 to 5 show the structure of the base station 1 in the first embodiment. In this embodiment, the base station 1 cleans the mop members 22111 by means of water cleaning, that is, the base station 1 washes the mop members 22111 to maintain the cleanness of the mop members 22111.

As shown in FIGS. 2 to 5, the base station 1 in this embodiment includes a base station body 10, a mop member cleaning device 11, a cleaning fluid supply device 12, a dirty fluid collection device 13, and a charging device 14.

The base station body 10 is defined to be a mounting base body for other structural components of the base station 1. The mop member cleaning device 11, the cleaning fluid supply device 12, and the dirty fluid collection device 13 are all arranged on the base station body 10. The base station body 10 provides supporting for these structural components that are mounted thereon.

Figure 2:
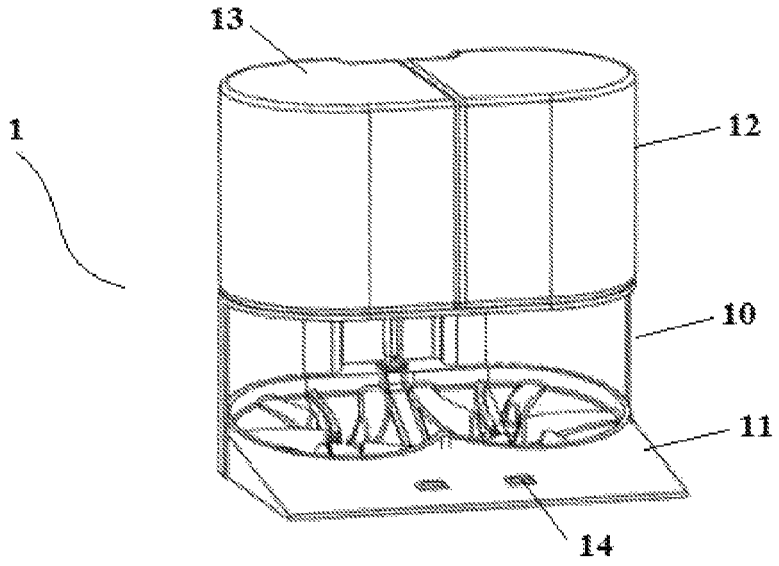
FIG. 2 is an overall structure view of a base station shown in FIG. 1.

As shown in FIG. 2, in this embodiment, the mop member cleaning device 11 is arranged below the base station body 10, the cleaning fluid supply device 12 and the dirty fluid collection device 13 are arranged above the base station body 10 and respectively located at the left and right sides of the base station body 10, thereby making the structure compact and beautiful. In this embodiment, the mop member cleaning device 11 is cooperated with the cleaning fluid supply device 12 and the dirty fluid collection device 13, to realize the cleaning for the mop members 22111 by means of water cleaning. In addition, since the mop unit 2211 in this embodiment is rotatable round the vertical axis, the mop unit 2211 and the mop member cleaning device 11 are rotatable relative to each other, so that the base station 1 can implement the water cleaning by the friction between the mop unit 2211 and the mop member cleaning device 11. During the cleaning process, the mop member 22111 is placed on the mop member cleaning device 11 and rotated for cleaning, the cleaning fluid supply device 12 is configured to supply cleaning fluid, and the dirty fluid collection device 13 is configured to collect dirty fluid after the cleaning.

Figure 4:
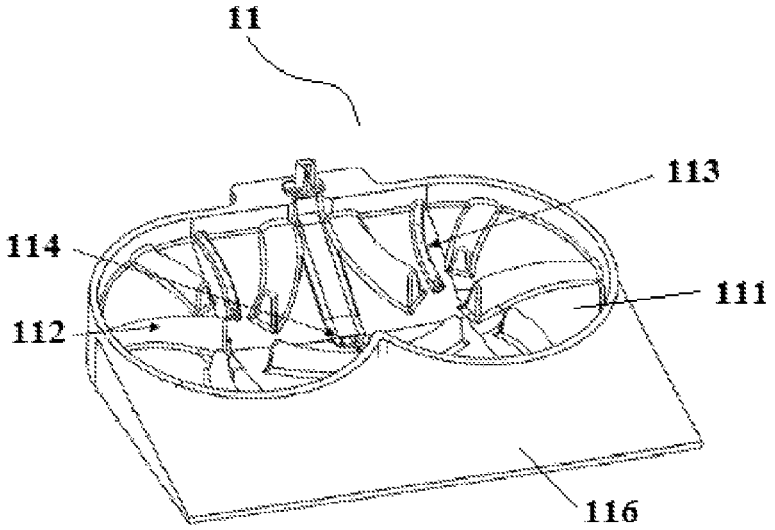
FIG. 4 is a structure of a mop member cleaning device shown in FIG. 2.

Specifically, as shown in FIG. 4, the mop member cleaning device 11 in this embodiment includes a cleaning notch 111, a protruding structure, a fluid inlet structure 113, and a fluid discharge structure 114. The protruding structure includes at least two protruding portions 112.

Figure 3:
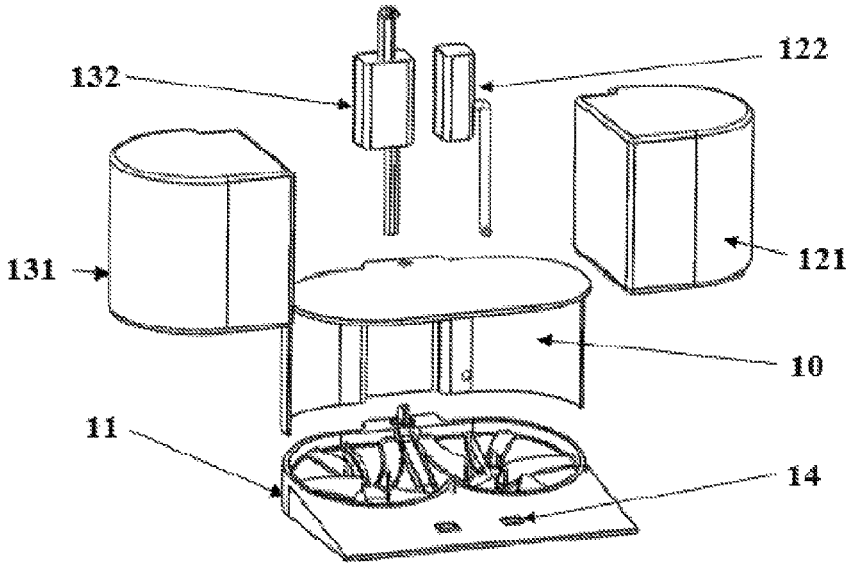
FIG. 3 is an exploded structure view of the base station shown in FIG. 2.

The cleaning notch 111 is configured to place the mop members 22111 during the process of the mop member cleaning device 11 cleaning the mop members 22111, and provide a containing space for the cleaning fluid. As shown in FIGS. 3 and 4, in this embodiment, the mop member cleaning device 11 includes two cleaning notches 111. The shape and size of each cleaning notch 111 are adapted to the shape and size of the mop unit 221 in this embodiment. The cleaning notch 111 has a circular cross section. This arrangement of the cleaning notch 111 corresponds to the shape, size and quantity of the mop unit 221 of the cleaning robot 2. In this way, the mop members 2111 and the cleaning fluid can be better received, thereby to prevent the cleaning fluid from splashing out. And the base station 1 can clean all the mop members 22111 of the cleaning robot 2 at the same time, thus improving the cleaning efficiency. The shape and size of the cleaning notch 111 can be arranged according to the specific structure of the mop units 2211. The number of the cleaning notch 111 may be arranged to be equal to the total number of the mop unit 221 of a plurality of cleaning robots 2, and one cleaning notch 111 is in one-to-one correspondence with one mop unit 221, so that the base station 1 can simultaneously clean all the mop members 22111 of the plurality of cleaning robots 2, which improves the cleaning efficiency.

The protruding structure is configured to be in contact with the mop members 22111 received in the cleaning notch 111. Since the entire surface of the mop member 22111 can be in contact with the protruding structure, the larger the contact area is, the higher the cleaning efficiency is. During the cleaning process, the protruding structure can scrape off fluid and increase the friction force, thereby further improving the cleaning effect. As shown in FIG. 4, in this embodiment, the protruding structure is disposed in the cleaning notch 111. Each of the protruding portions 112 is curved, namely an extending path of the cross section of the protruding portion 112 is a curve, and the plurality of protruding portions 112 in each cleaning notch 111 are radially arranged. The protruding structure as shown in this embodiment is better adapted to the rotational movement of the mop member 22111, so that the protruding structure rubs the rotated mop members 22111 more fully during the cleaning process, thereby to achieve better cleaning effect. In addition, when the mop members 22111 are rotated, water is squeezed out from the mop members 22111 under the action of mutual extrusion and friction between the mop members 22111 and the protruding structure, and then thrown away from the mop members 22111 under the action of the rotation of the mop members 22111, thus the protruding structure can also dry the mop member 22111.

Both the fluid inlet structure 113 and the fluid discharge structure 114 are connected with the cleaning notch 111, so that the cleaning fluid can flow into the cleaning notch 111 through the fluid inlet structure 113 and be sprayed on the mop member 22111, and after cleaning the mop members 22111 the cleaning fluid can be discharged outside of the cleaning notch 111 through the fluid discharge structure 114. As shown in FIG. 4, in this embodiment, the fluid inlet structure 113 and the fluid discharge structure 114 are both disposed in the cleaning notch 111. The two may also be disposed at other positions, as long as the two are connected with the cleaning notch 111.

The cleaning fluid supply device 12 is connected with the cleaning notch 111 via the fluid inlet structure 113, so as to conveniently supply the cleaning fluid to the cleaning notch 111. The dirty fluid collection device 13 is connected with the cleaning notch 111 through the fluid discharge structure 114, so as to conveniently collect the dirty cleaning fluid after cleaning the mop members 22111. Combined with FIGS. 3 and 4, in this embodiment, the cleaning fluid supply device 12 includes a first storage unit 121 and a first water pump 122. The first storage unit 121 is configured to contain the cleaning fluid, and the first water pump 122 is used as a first power device, which is configured to drive the cleaning fluid to flow to the cleaning notch 111 from the first storage unit 121. The dirty fluid collection device 13 includes a second storage unit 131 and a second water pump 132. The second storage unit 131 is configured to store the dirty cleaning fluid, and the second water pump 132 is used as a second power device, which is configured to pump the dirty cleaning fluid into the second storage unit 131.

Figure 5:
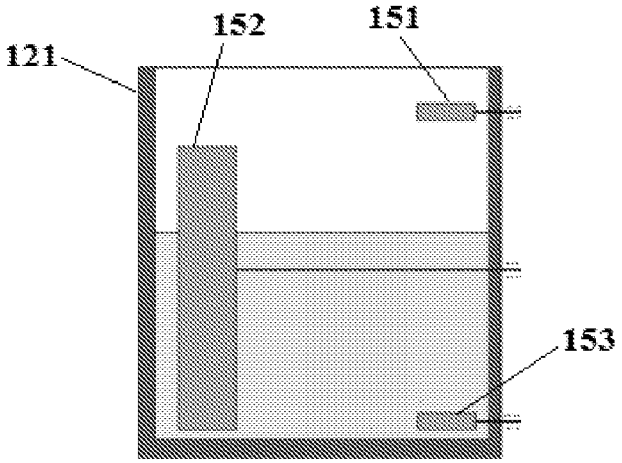
FIG. 5 is an installation view of a fluid level detection device in the first storage unit.

In order to facilitate users to know the fluid level of the cleaning fluid in the first storage unit 121 and the second storage unit 131 in time, in this embodiment, the base station 1 further includes a fluid level detection device for detecting the fluid level of the cleaning fluid. Specifically, as shown in FIG. 5, in this embodiment, the fluid level detection device is arranged in the first storage unit 121 and the second storage unit 131. The fluid level detection device includes a first conductive element 151, a second conductive element 152, and a third conductive element 153. The first conductive element 151 is configured for detecting the capacitance value of environment. The second conductive element 152 and the third conductive element 153 are arranged in the storage unit which contains the cleaning fluid to be detected, namely, the second conductive element 152 and the third conductive element 153 are arranged in the first storage unit 121 and the second storage unit 131. The second conductive element 152 is configured for detecting the capacitance difference caused by the fluid level change of the cleaning fluid, and the third conductive element 153 is configured for detecting the capacitance value of the cleaning fluid. Since different fluid levels produce different capacitance values, the fluid level detection device can detect the fluid levels of the cleaning fluid in the first storage unit 121 and the second storage unit 122 in real time, thereby convenient for adding new cleaning fluid into the first storage unit 121, or emptying the second storage unit 131. The first conductive element 151 and the second conductive element 152 are used to correct the detection data of the measured fluid level, to make the fluid level detection result more accurate. A specific calibration process may refer to the following formula:

$$H = \gamma \frac{C_2 - C_{20}}{C_3 - C_1}$$

H: final fluid level obtained;

$C_2$: capacitance value measured by the second conductive element 152 when there is a certain fluid level;

$C_{20}$: capacitance value measured by the second conductive element 152 when there is no fluid in the storage unit;

$C_3$: capacitance value measured by the third conductive element 153 (when covered by the fluid);

$C_1$: capacitance value measured by the first conductive element 151 (in air);

$\gamma$: correction parameter.

Figure 23:
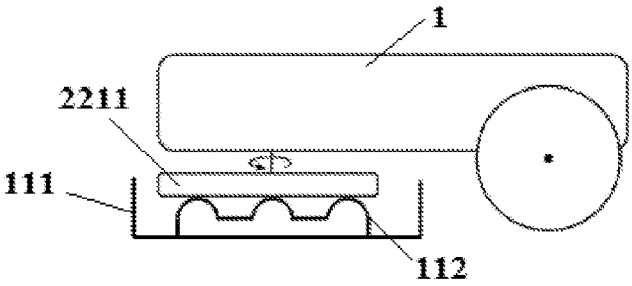
FIG. 23 illustrates a mechanism of the base station according to the first embodiment shown in FIG. 1 cleaning the mop member of the cleaning robot.
Figure 24:
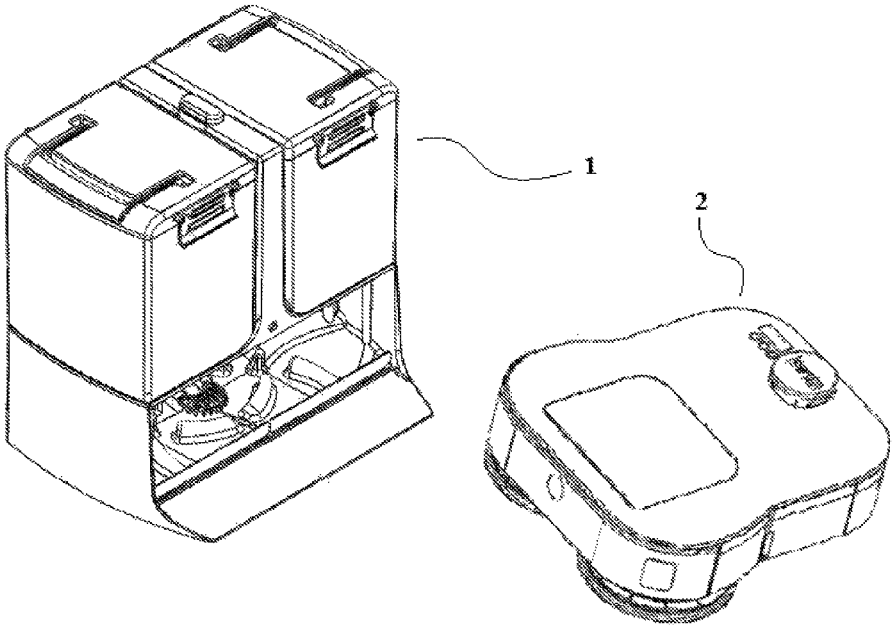
FIG. 24 is an overall structure view of a cleaning robot system according to a second embodiment in the present disclosure.

During the operation of the base station 1 in this embodiment, referring to FIG. 23, the mop member 22111 is received in the cleaning notch 111 and is rotated around the vertical axis with the entire surface being tightly pressed against the protruding structure. The cleaning fluid in the first storage unit 121 after being pressurized by the first water pump 122 is sprayed on the mop members 22111 received in the cleaning notch 111 through the fluid inlet structure 113. The impact force produced during the spraying helps to further improve the cleaning effect. The dirty cleaning fluid after the cleaning is scraped off the mop members 22111 by the protruding portion 112, and thrown away from the mop members 22111 under the action of a centrifugal force when the mop members 22111 are rotated, to flow to the fluid discharge structure 114, and then pumped into second storage unit 131 by second water pump 132.

As can be seen, the cleaning fluid supply device 12 and the dirty fluid collection device 13 are cooperated to maintain the cleanness of the cleaning fluid in the cleaning notch 111, which avoids a secondary pollution to the mop members 22111, thereby further guaranteeing the cleaning effect. In addition, the rotation of the mop members 22111 during the cleaning process plays a role in centrifugal drying, which avoids the cleaned mop members 22111 being over-wet. By this way, it can prevent the mop members 22111 from leaving more water on the floor during the mopping process to affect the cleanliness of the floor, also it can prevent the mop members 22111 from being too wet to apply to a special floor such as a wooden floor, thus effectively expanding the application range of the cleaning robot 2. Based on this, during the cleaning process, the mop members 22111 may be controlled to keep a proper rotation speed to rub the protruding portion 112 for cleaning purpose, and also controlled not to rotate too fast, so as to prevent the cleaning fluid from being thrown out. And after the cleaning, the fluid inlet structure 113 stops feeding the cleaning fluid, the mop members 22111 may be controlled to rotate at a lower rotation speed for a period of time to dry most of the moisture, and then controlled to accelerate the rotation speed for further drying. The specific rotation speed and the degree of drying can be adjusted according to actual needs.

In this embodiment, the cleaning fluid may be water, or a mixture of water and a cleaning agent. The mixture of water and the cleaning agent is preferable, because it has a better effect in cleaning the mop members 22111. On condition that using the mixture of water and the cleaning agent as the cleaning fluid, the first storage unit 121 may include only one container in which the mixture is directly contained; or the first storage unit 121 may include two containers, wherein, one is used for containing the cleaning agent, and the other one is used for containing the water. In this case, the first water pump 122 simultaneously drives the cleaning agent and the water to directly flow to the cleaning notch 111 from the respective containers. Or the first power device further includes a third water pump. The third water pump drives the cleaning agent to mix with the water, and then the first water pump 122 drives the mixed mixture with water and cleaning agent to flow into the cleaning notch 111.

Further, in order to facilitate to control the moisture of the mop member 22111, the base station 1 in this embodiment may further include a drying device. The drying device is configured to dry the mop members 22111 after the cleaning, so that the mop members 22111 retains a moderate amount of moisture when the cleaning robot 2 moves out of the base station 1, which prevents the floor from being slippery and prevents the mop member 22111 from getting moldy due to excessive moisture. And with the drying device, the drying process can be finished inside the base station 1, which enriches the functions of the base station 1 and simplifies the post-processing steps, thereby improving the efficiency.

In addition, to facilitate the cleaning robot 2 to move into and out of the base station 1, the base station 1 may further include a guiding structure disposed on the mop member cleaning device 11. The guiding structure is configured to guide the cleaning robot 2 to move relative to the mop member cleaning device 11, thereby allowing the mop members 22111 to get in and out of the mop member cleaning device 11. Specifically, as shown in FIG. 4, in this embodiment, the base station 1 includes a guiding surface 116 serving as the guiding structure. The guiding surface 116 is inclined obliquely downward from the mop member cleaning device 11 (specifically, an edge of the cleaning notch 111) and extends to the floor. In this manner, the guiding surface 116 can guide the cleaning robot 2 to move along the guiding surface 116 to the height of the edge of the cleaning notch 111, thus convenient for the mop members 22111 to get in the cleaning notch 111. As shown in FIGS. 21 and 22, the guiding surface 116 is cooperated with the above lifting mechanism 24 of the cleaning robot 2, to facilitate the cleaning robot 2 to move in and out of the base station 1, thereby improving the working efficiency of the cleaning robot system. The guiding structure is not limited to the structure shown in this embodiment. The guiding structure may include a guiding plate 116 and/or a guiding wheel 119, both of which will be detailed in the second embodiment shown in FIGS. 24 to 35 and the embodiment shown in FIG. 53.

Figure 28:
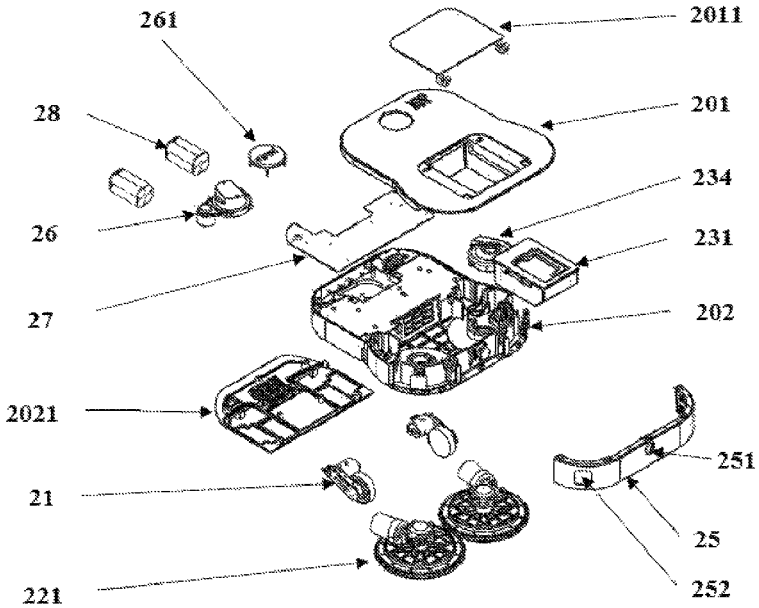
FIG. 28 is an exploded structure view of the cleaning robot shown in FIG. 27.
Figure 29:
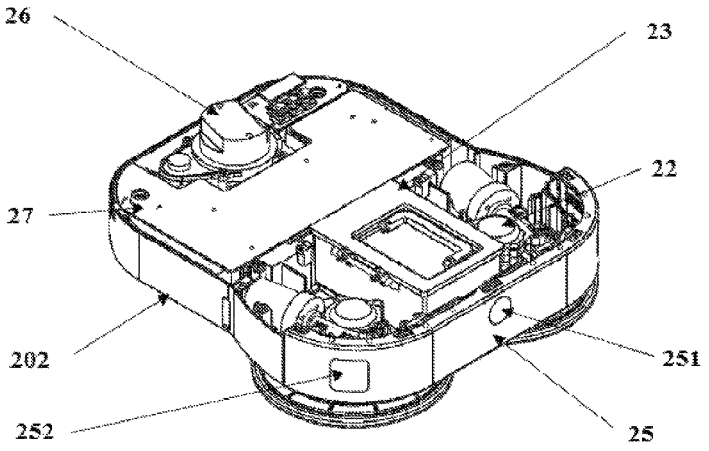
FIG. 29 is a structure view of the cleaning robot shown in FIG. 27 with a upper housing and a upper housing cover being removed.
Figure 30:
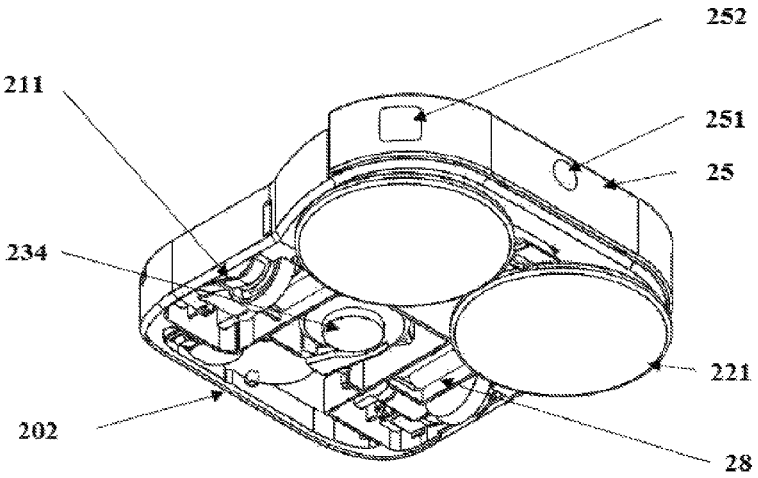
FIG. 30 is a structure view of the cleaning robot shown in FIG. 27 with a lower housing cover being removed.
Figure 31:
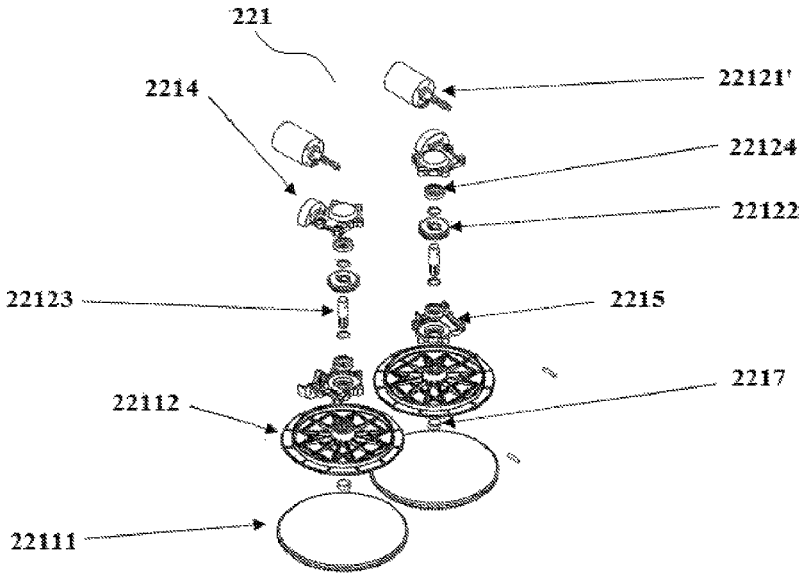
FIG. 31 is an exploded structure view of a mop device shown in FIG. 30.

The charging device 14 is configured to dock with the battery 28 of the cleaning robot 2 for the purpose of charging, to realize the charging function of the base station 1. As shown in FIGS. 2 to 4, in this embodiment, the charging device 114 is disposed on the guiding surface 116. As such, the charging device 114 can charge the cleaning robot 2, when the cleaning robot 2 moves onto the guiding surface 116. The charging device 14 charges the cleaning robot 2 in many ways. For example, a contact-type charging method can be realized by the contact of a charging element 141 arranged on the base station 1 with a charging contact element 252 arranged on the cleaning robot 2 (as shown in FIGS. 28 and 29). For another example, a wireless charging method can be realized by the cooperation of an induction coil arranged on the chassis 202 of the cleaning robot 2 with a charging coil arranged on the guiding surface 116 of the base station 1.

FIGS. 24 to 35 illustrate a second embodiment of the cleaning robot system.

As shown in FIGS. 24 to 35, the second embodiment is substantially same as the first embodiment. The base station 1 is configured to charge the cleaning robot 2 and clean the two mop members 22111 of the cleaning robot 2, the two mop members 22111 are rotatable around the vertical axis in opposite directions, and each of the mop members 22111 is swingable relative to the chassis 202. Main differences between the two embodiments are as follows: in one aspect, the structures of the mop drive mechanisms 2212 for driving the two mop members 22111 to rotate round the vertical axis in opposite directions are different; in another aspect, the mop members 22111 swing relative to the chassis 202 in different ways; in another aspect, the structures of the rubbish collection devices 23 are slightly different; and in another aspect, the structures of the base station bodies 10, the first storage units 121, the second storage units 131, and the guiding structures are slightly different. The differences of the above four aspects will be described below, and other undescribed points can be understood reference to the first embodiment. In addition, only the differences are highlighted as described.

FIGS. 27 to 34 illustrate the structure of the cleaning robot 2 in this second embodiment.

As shown in FIGS. 28 to 31, in the second embodiment, although the mop drive mechanism 2212 uses the worm gear and worm mechanism to transmit torques to the output shafts 22123, the worm motor of the worm gear and worm mechanism adopts two single-head worm motors 22121' instead of the double-head worm motor 22121. Each of the single-head worm motors 22121' is meshed with each of the two worm gears 22122 of the worm gear and worm mechanism in one-to-one correspondence, so that the two sets of the worm gears can rotate in different directions to drive the two mop members 22111 to rotate around the vertically arranged output shafts 22123 in opposite directions, which maintains a relative dynamic balance of the head portion of the cleaning robot 2, improves the mopping effect, and gathers the rubbish to the middle for the rubbish collection device 23 to collect.

Figure 32A:
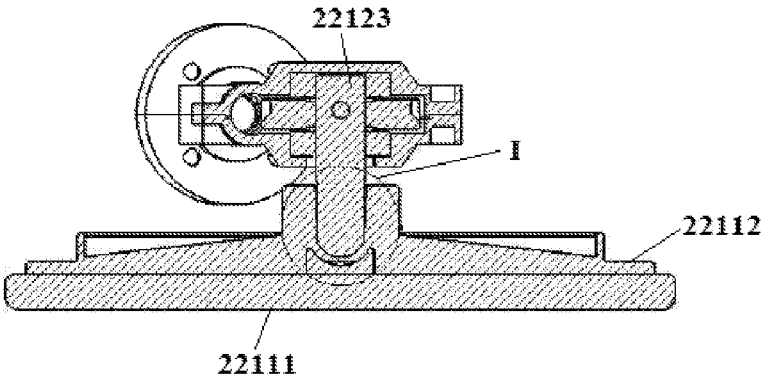
FIG. 32*a* is a cross-sectional view of the assembled structure of the output shaft and the mop unit shown in FIG. 31.
Figure 32B:
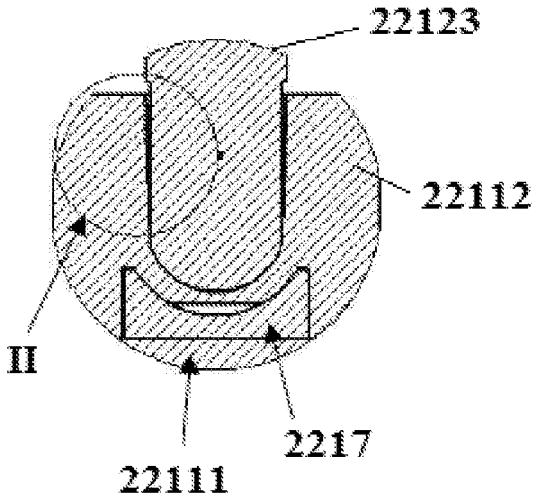
FIG. 32*b* is a partial enlarged view of I shown in FIG. 32*a;*
Figure 32C:
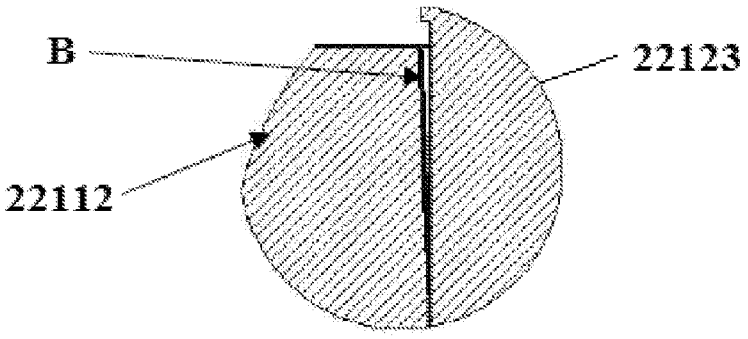
FIG. 32*c* is a partial enlarged view of II shown in FIG. 32*b;*

As shown in FIGS. 32*a* and 32*c*, to realize the swingable connection between the mop unit 2211 and the mop drive mechanism 2212, thereby to realize the swingable connection between the mop unit 2211 and the chassis 202, in the second embodiment, the output shaft 22123 and the mop unit 2211 are not connected with the flexible connection structure such as the flexible connection block 22126, instead, the connection by which the mop unit 2211 is connected with the mop drive mechanism 2212 is a gap sleeve connection. Specifically, as shown in FIG. 32*c*, in the second embodiment, the gap sleeve connection is used for connecting the output shaft 22123 with the platen 22112. The gap between the output shaft 22123 and the platen 22112 allows the platen 22112 to swing relative to the output shaft 22123 with a gap swing angle and a gap swing space. And since the mop members 22111 are arranged on the platen 22112, on condition that the gap sleeve connection is used for connecting the mop unit 2211 with the mop drive mechanism 2212, the swingable connection between the mop unit 2211 and the chassis 202 is realized by the gap motion, so that the mop member 22111 is allowed to change its swinging angle according to the floor surface, so as to be more adaptive to the floor surface.

In addition, as shown in FIG. 32*b*, in this embodiment, the mop unit 2211 is detachably connected with the mop drive mechanism 2212, in order to facilitate the mop unit 2211 to be easily disassembled and assembled, a magnetic adsorption member 2217 which is configured to attract the mop unit 2211 with the mopping connecting structure is disposed between the platen 22112 of the mop unit 2211 and the output shaft 22123 of the mop drive mechanism 2212. By arranging the magnetic adsorption member 2217, the platen 22112 is detachably connected with the output shaft 22123 rather than be fixedly connected with the output shaft 22123. The magnetic adsorption allows users to disassemble and install the mop unit 2211 without any tools, which is easy and convenient. The detachable connection between the mop unit 2211 and the mop drive mechanism 2212 may adopt one or more of other ways, such as a threaded connection element, or/and a buckle element, or/and a hook element.

Figure 33:
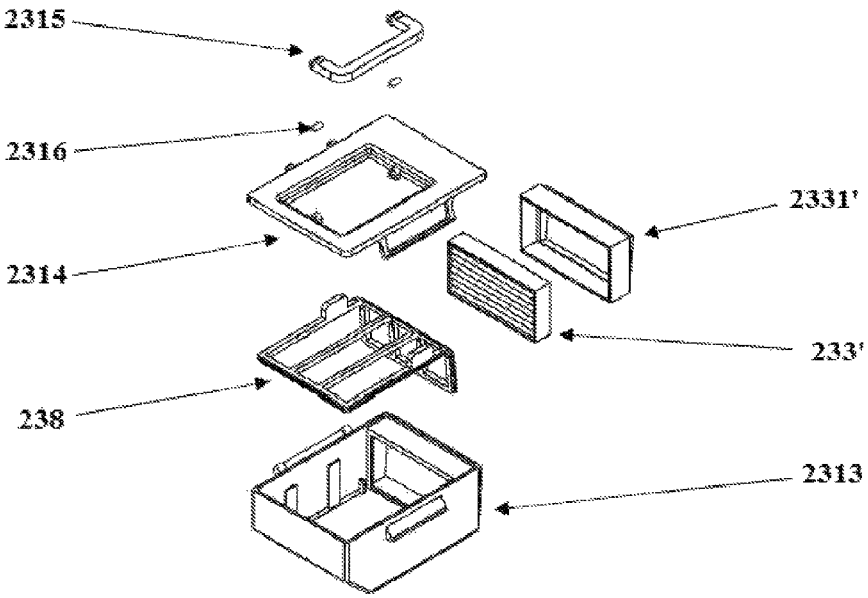
FIG. 33 is an exploded structure view of a rubbish collection device according to the second embodiment (omitting the dust removal fan)
Figure 34:
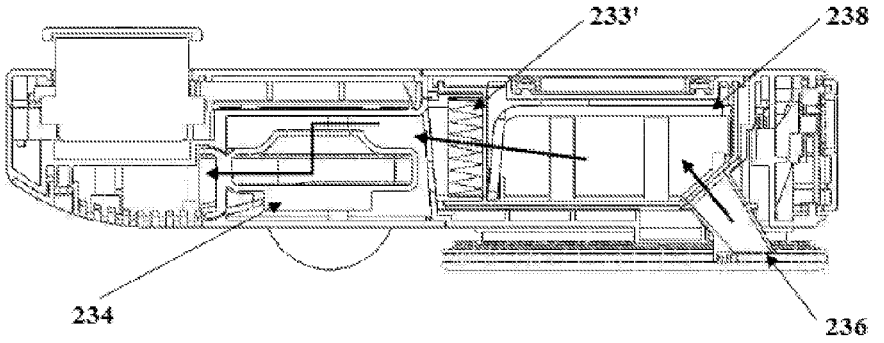
FIG. 34 illustrates an air passage of the rubbish collection device according to the second embodiment.

As shown in FIGS. 33 and 34, in the second embodiment, the rubbish collection device 23 uses the dust suction device, and the dust suction port 236 is disposed at the middle of the front of the two mop members 22111. However, compared to the above first embodiment, the filter structure uses a HEPA paper 233' instead of the filter net 233. The HEPA paper 233' is configured for filtering dust in airflow. A HEPA frame 2331' is correspondingly provided for supporting the HEPA paper 233'. And a filter frame 238 is disposed between the bin body 2313 and the bin lid 2314 of the dust bin 231. The HEPA paper 233' is disposed outside the filter frame 238, and located on a path where the bin body 2313 is connected with the dust removal fan 234. In addition, a handle 2315 is disposed on the bin lid 2314. The handle 2315 is mounted on the bin lid 2314 by a positioning pin 2316, which is convenient for users to remove the dust bin 231 and empty the dust in the dust bin 231 in time.

In addition to the above main differences, the cleaning robot 2 in the second embodiment has some other differences from the cleaning robot 2 in the first embodiment. As shown in FIG. 28, the structure of the housing 20 of the cleaning robot 2 in the second embodiment is slightly different. The upper housing 201 is provided with a battery mounting groove for mounting the battery 28, and correspondingly, the battery mounting groove is provided with an upper housing cover 2011 thereon for shielding the battery mounting groove and the battery 28 therein, thereby to protect the battery 28 and maintain the overall beauty. The bottom of chassis 202 is additionally provided with a lower housing cover 2021, to facilitate the disassembly and maintenance. In addition, a camera 251 and a charging contact element 252 are further provided on the collision sensing plate 25. The camera 251 is configured to cooperate with the laser radar 26, for better scanning position and obstacle recognition. The charging contact element 252 is configured to be in contact with a charging element 141 on the base station 1 for charging the battery 28.

Figure 25:
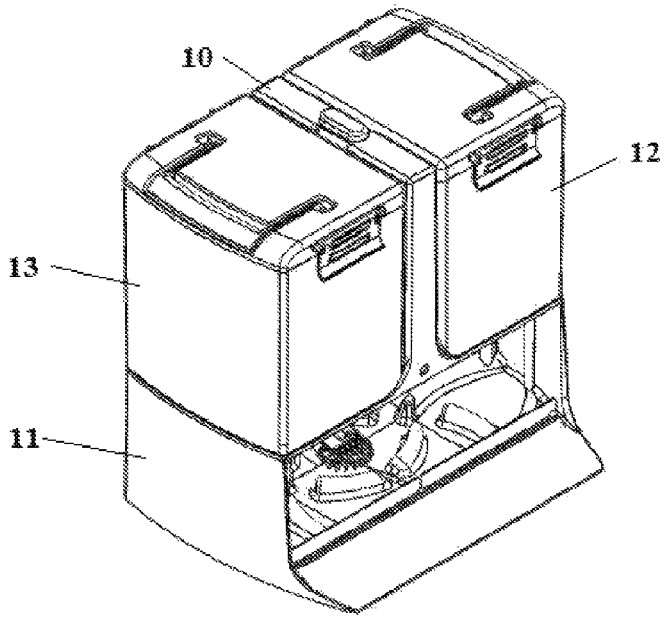
FIG. 25 is an overall structure view of a base station shown in FIG. 24.
Figure 26:
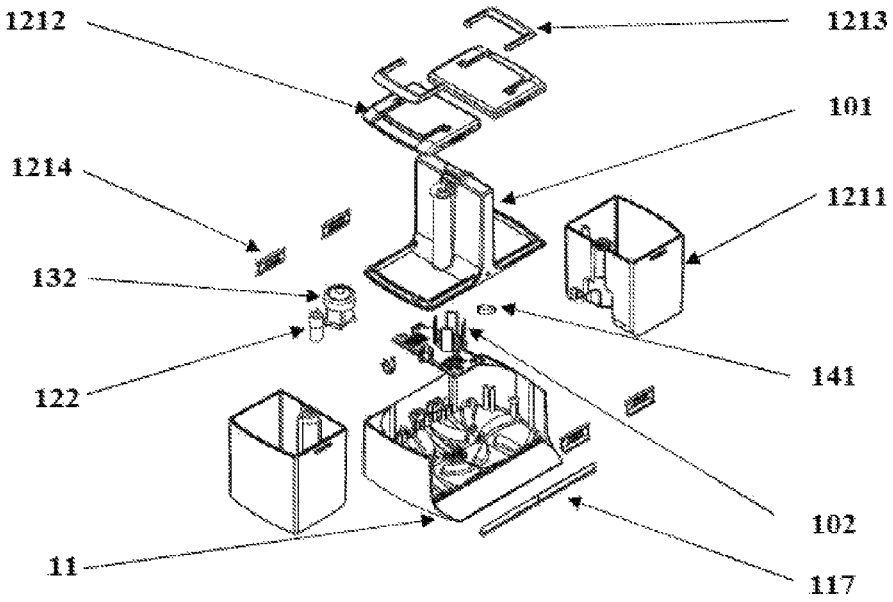
FIG. 26 is an exploded structure view of the base station shown in FIG. 25.
Figure 27:
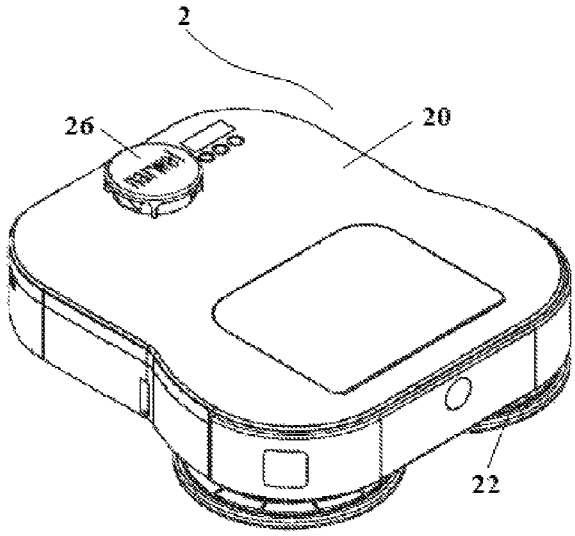
FIG. 27 is an overall structure view of a cleaning robot shown in FIG. 24.

FIGS. 25 to 26 show the structure of the base station 1 in the second embodiment.

As shown in FIGS. 25 and 26, in the second embodiment, the base station body 10 includes a supporting frame 101 and a supporting-frame bottom lid 102. The cleaning fluid supply device 12 and the dirty fluid collection device 13 are disposed on the supporting frame 101, and located on two sides of the supporting frame 101. The supporting-frame bottom lid 102 is disposed at the bottom of the supporting frame 101. The first storage unit 121 and the second storage unit 131 each includes a bin body 1211, a bin lid 1212, a handle 1213 and a buckle 1214. The bin lid 1212 is covered at the top opening of the bin body 1211. The handle 1213 is disposed on the bin lid 1212 for convenient carrying. The buckle 1214 is arranged at a position where the bin body 1211 is in contact with the bin lid 1212, to realize a buckle connection between the bin body 1211 and the bin lid 1212.

As shown in FIGS. 25 and 26, in the second embodiment, the notch of the cleaning notch 111 is provided with a scraping and blocking member 117, for example, a scraping and blocking blade. The scraping and blocking member 117 is disposed at the notch of the cleaning notch 111, which increases the height of the cleaning notch 111. In one aspect, the cleaning fluid in the cleaning notch 111 is prevented from splashing out of the cleaning notch 111 during the process of the mop member cleaning device 11 cleaning the mop members 22111 by the scraping and blocking member 117, thus the scraping and blocking member 117 serves as a waterproof bar. In another aspect, as the mop member 22111 passes the scraping and blocking member 117 before getting in the cleaning notch 111, rubbish stuck to the mop members 22111 can be scraped off by the scraping and blocking member 117 before the mop member 22111*s* gets into the mop member cleaning device 11, which prevents the rubbish from entering the cleaning notch 111 to clog the fluid inlet structure 113 and the fluid discharge structure 114. The scraping and blocking member 117 may be flexible or rigid. Preferably, the scraping and blocking member 117 uses a flexible element, such as a rubber scraping blade. In one aspect, the mop members 22111 can be elastically pressed against the scraping and blocking member 117 when getting in the cleaning notch 111, which enhances the scraping action of the scraping and blocking member 117. In another aspect, the scratching to the mop members 22111 is reduced. In yet another aspect, if the scraping and blocking member 117 is a flexible element, the scraping and blocking member 117 will undergo elastic deformation and return to the original state by itself after the mop members 22111 completely gets into the cleaning notch 111, to prevent the cleaning fluid from splashing again. The scraping and blocking member 117 may also be disposed on the guiding surface 116, as long as it prevents the splashing of the cleaning fluid and/or scrapes the rubbish in advance.

Figure 35:
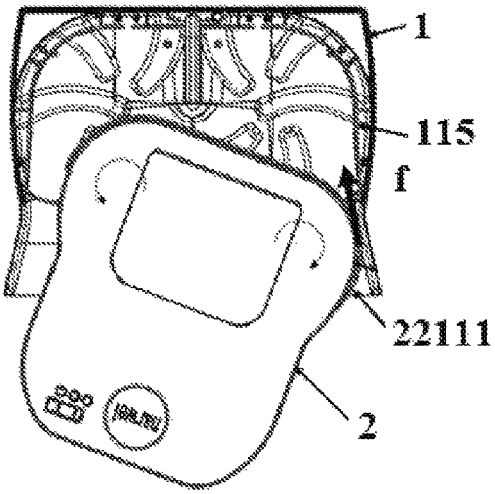
FIG. 35 illustrates a movement of the cleaning robot according to the second embodiment getting in the base station.

As shown in FIG. 35, to facilitate the cleaning robot 2 to move into the base station 1, in the second embodiment, the guiding structure of the base station 1 further includes a guiding plate 115 disposed on a lateral side of the mop member cleaning device 11, preferably the guiding plate 115 extends to the bottom of the guiding surface 116 along the inclined direction of the guiding surface 116. Both the guiding plate 115 and the guiding surface 116 guide the mop members 22111 of the cleaning robot 2 to get in the mop member cleaning device 11 more accurately and quickly. As shown in FIG. 35, the two mop members 22111 are rotated in opposite directions, and when the cleaning robot 2 moves in the base station 1, if one of the mop members 22111 comes in contact with the guiding plate 115, the deviation of the route of the cleaning robot 2 can be corrected by a friction force between the mop members 22111 and the guiding plate 115, thereby to drive the cleaning robot 2 to move into the base station 1 along a correct track. As can be seen, the guiding plate 115 can correct the deviation of the route of the cleaning robot 2 moving in and out of the base station 1.

Figure 53:
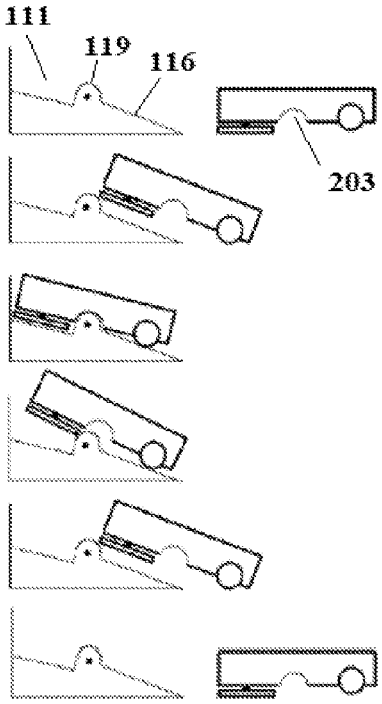
FIG. 53 illustrates a process of the cleaning robot getting in and out the base station based on the guiding surface and the guiding wheel.

In the first embodiment and the second embodiment, the lifting mechanism 24 is cooperated with the guiding structure of the base station 1, to facilitate the cleaning robot 2 to move into the base station 1. It can also be realized by the guiding action of the guiding structure without the lifting mechanism 24. As shown in FIG. 53, the guiding structure of the base station 1 includes not only the preceding guiding surface 116, but also a guiding wheel 119. The guiding wheel 119 is arranged on the guiding surface 116 and protrudes upward. In this case, when moving into the base station 1, the cleaning robot 2 first moves to the height of the guiding wheel 119 by its own driving force under the guiding action of the guiding surface 116, and the front end of the cleaning robot 2 is raised under the action of the guiding wheel 119 until the mop members 2211 crosses over the guiding wheel 119 and enters the cleaning notch 111, the entering process is finished. And when the mop members 22111 needs to exit the base station 1 after the cleaning, the cleaning robot 2 falls back, and finishes the exiting process under the action of the guiding wheel 119 and the guiding surface 116. In addition, to prevent the upwardly projecting guiding wheel 119 from interfering with the contact of the mop members 22111 with the cleaning surface during the cleaning process, referring to FIG. 53, an avoiding slot 203 is defined in the cleaning robot 2, which is configured to adapt to the guiding wheel 119. After the mop unit 2211 crosses over the guiding wheel 119 and enters the cleaning notch 111, the guiding wheel 119 is embedded in the avoiding slot 203, so that the mop members 22111 can be in close contact with the cleaning surface, thereby ensuring the cleaning effect.

Figure 37:
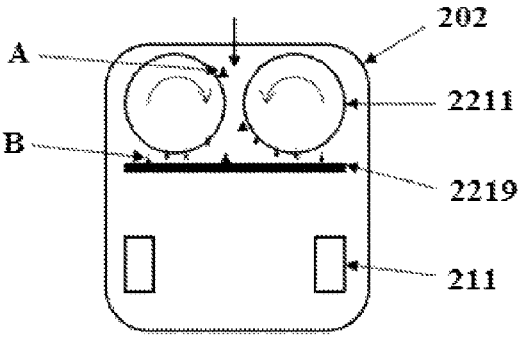
FIG. 37 illustrates another variant of the first embodiment and the second embodiment.
Figure 38:
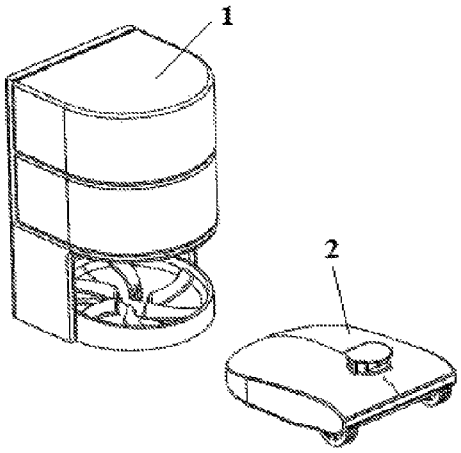
FIG. 38 is an overall structure view of a cleaning robot system according to the third embodiment in the present disclosure.
Figure 39:
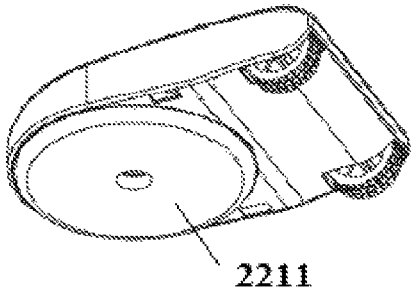
FIG. 39 is a bottom perspective view of the overall structure of a cleaning robot shown in FIG. 38.

FIG. 37 shows an improved embodiment of the first embodiment and the second embodiment described above.

As shown in FIG. 37, this embodiment differs from the first embodiment and the second embodiment mainly in that, the mop device 221 of the cleaning robot 2 in this embodiment further includes a scraping and blocking structure 2219 disposed behind the mop unit 2211. The scraping and blocking structure 2219 is configured to scrape and block rubbish and/or fluid dropped from the mop unit 221, to prevent the rubbish and/or the fluid from remaining on the floor that has been mopped by the mop unit 2211, thereby to realize a secondary cleaning. The scraping and blocking structure 2219 may be a scraping blade or a cloth strip or the like, preferable a flexible member which is advantageous for reducing scratching damages to the floor surface. The scraping and blocking structure 2219 is not limited to be applicable to the cleaning robot 2 described in the first embodiment and the second embodiment, it is also applicable to other cleaning robots 2 in the present disclosure.

FIGS. 38 to 41 show a third embodiment of the cleaning robot system.

As shown in FIGS. 38 to 41, the third embodiment differs from the foregoing two embodiments mainly in that, the mop device 221 of the cleaning robot 2 in this embodiment includes one mop unit 2211, and correspondingly, the mop member cleaning device 11 of the base station 1 in this embodiment includes one cleaning notch 111. In addition, the cleaning fluid supply device 12 and the dirty fluid collection device 13 of the base station 1 are stacked one above the other for a more compact structure. The cleaning robot 2 and the base station 1 in this embodiment both have smaller structures, thus more suitable for small families.

Figure 40:
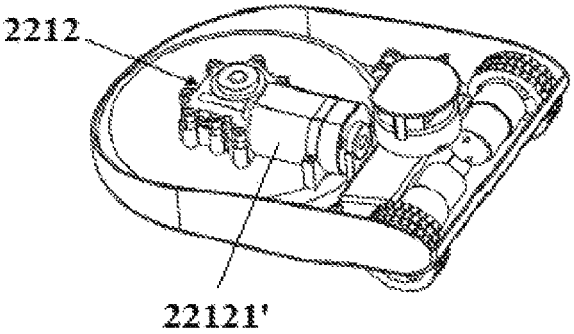
FIG. 40 is a structure view of the cleaning robot shown in FIG. 38 with the upper housing being removed.
Figure 41:
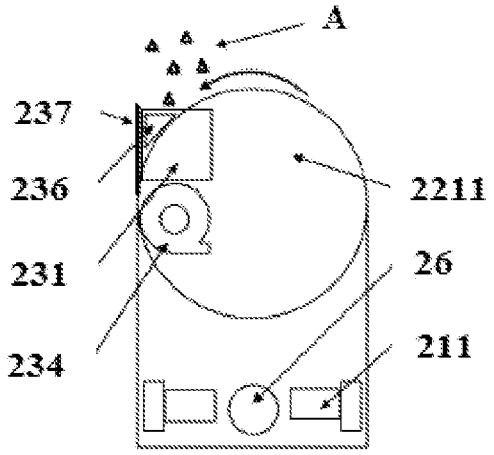
FIG. 41 illustrates the positional relationship between the suction port and the mop device according to the third embodiment.

As shown in FIG. 41, in the third embodiment, the mop unit 2211 is rotatable relative to the chassis 202 around the vertical axis. To realize the rotation of the mop unit 2211 around the vertical axis, as shown in FIG. 40, the mop drive mechanism 2212 in this embodiment uses the worm motor to output the torque. But the difference is that the worm motor in this embodiment includes one single-head worm motor 22121' and one worm gear 22122. The single-head worm motor 22121' and the worm gear 22122 are engaged to drive the mop unit 2211 to rotate around the vertical axis, thereby to achieve a better effect on floor cleaning.

Based on the cleaning device 22 including one mop unit 2211, for a more thorough rubbish collection, as shown in FIG. 41, in this embodiment, the dust suction port 236 of the rubbish collection device 23 is disposed on the outside of the edge of the mop unit 2211. The rubbish is gathered by the edge of the mop member 2211 to the outside of the mop unit 2211 with the rotation of the mop unit 2211, thus, the dust suction port 236 acting as the collection port is positioned on the path where the mop unit 2211 gathers the rubbish, which is convenient to collect the rubbish into the dust bin 231. Further, in this embodiment, a rubbish blocking member 237 is disposed on a side wall of the housing 20, and the dust suction port 236 is disposed between the edge of the mop unit 2211 and the rubbish blocking member 237, so that the rubbish is gathered to a smaller area under the blocking action of the rubbish blocking member 237, which realizes a more effective collection.

Figure 48:
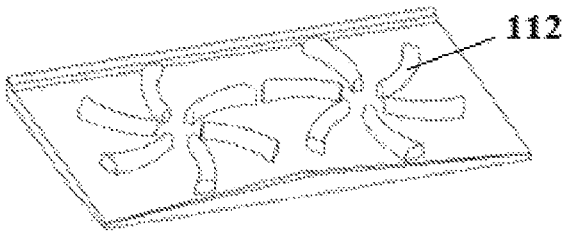
FIGS. 48 and 49 respectively illustrate two modified structures of the protruding structure according to the present disclosure.
Figure 49:
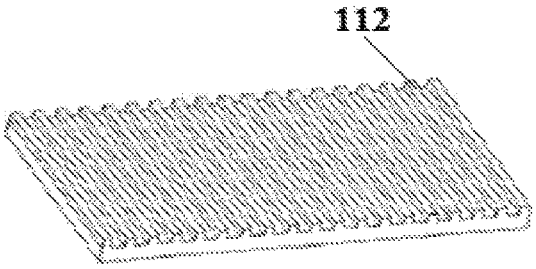

In the above three embodiments, the structures of the cleaning notches 111 and the protruding structures are substantially the same. The cleaning notch 111 is a deep notch having a circular cross section, and the protruding structure includes a plurality of curved protruding portions that are in radial arrangement. However, it should be noted that, in the present disclosure, the specific structures of the cleaning notch 111 and the protruding structure are not limited to the structures described in the three embodiments. Taking the modified embodiment shown in FIGS. 48 and 49 for example, the cleaning notch 111 may be a cleaning disk which is a shallow disk having a rectangular cross section. And the protruding portion 112 may be a straight protruding portion or a polyline protruding portion, namely, the extending path of the cross section of the protruding portion 112 is straight or polyline. The arrangement of the plurality of protruding portions 112 may be radial arrangement or other forms, for example, array arrangement. The array arrangement may be straight array arrangement (namely, matrix arrangement), circular array arrangement, or annular array arrangement or the like. The straight array arrangement is particularly suitable for the case that the mop member 22111 horizontally reciprocates relative to the mop member cleaning device 11, so as to clean the mop member 22111 more cleanly. Besides the shape of each protruding portion 112 in each cleaning notch 111 is different, that is, the plurality of protruding portions 112 may include any combination of the curved protruding portion, the straight protruding portion, and the polyline protruding portion. Similarly, the arrangement of the protruding portions 112 in each cleaning notch 111 may also be any combination of various arrangements such as the radial arrangement and the array arrangement. Also the shapes and the arrangements of the protruding portions 112 in different cleaning notches 111 may be the same or different.

In another embodiment, the protruding portion 112 includes a bottom protrusion 1121 arranged at the bottom of the cleaning notch 111 and a side protrusion 1122 formed on the inner side of the cleaning notch 111. During the process of the mop member cleaning device 11 cleaning the mop member 22111, the mop member 22111 rotates relative to the bottom protrusion 1121, and the bottom protrusion 1121 extrudes and rubs the bottom surface of the mop member 22111; in addition, the mop member 22111 rotates relative to the side protrusion 1122, and the side protrusion 1122 extrudes and rubs the side surface of the mop member 22111. By this way, the bottom surface of the mop member 22111 is cleaned by the bottom protrusion 1121, and the side surface of the mop member 22111 is cleaned by the side protrusion 1122.

There may be various ways to clean the side surface of the mop member 22111. For example, the edges of the two mop members 22111 are arranged to touch each other. In this way, when the two mop members 22111 rotate in opposite directions, the two mopping members 22111 rub against each other at the contact position so as to clean the side surface of the two mopping members 22111.

Figure 54:
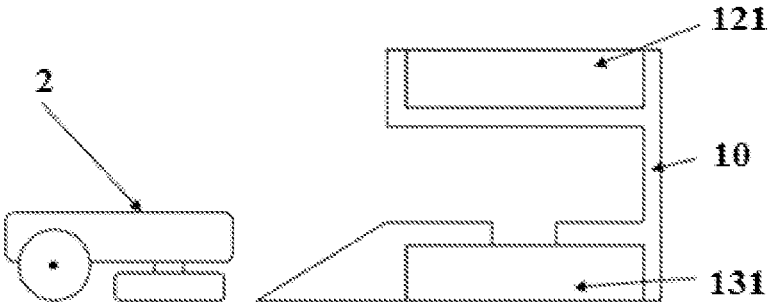
FIG. 54 is a structure view of a cleaning robot system according to a sixth embodiment in the present disclosure.
Figure 55:
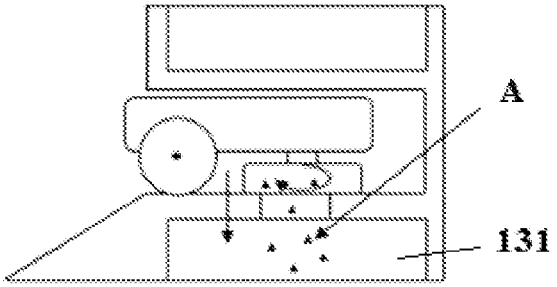
FIG. 55 illustrates a state of a base station according to the sixth embodiment shown in FIG. 54 cleaning the cleaning robot.
Figure 56:
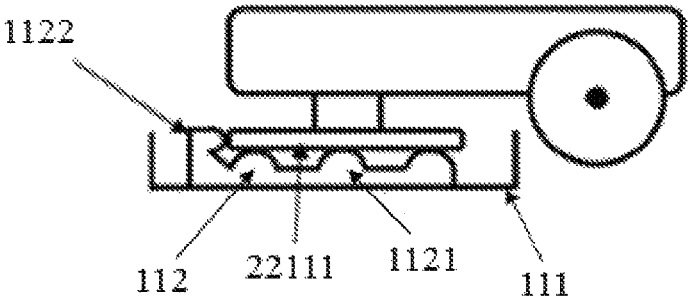
FIG. 56 illustrates a mechanism of a base station in another embodiment according to the present disclosure cleaning the mop member of the cleaning robot.

In the above three embodiments, the dirty fluid collection devices 13 all collect the dirty cleaning fluid by the pumping action of the second power devices. However, in other embodiments according to the present disclosure, the second power device is not arranged, instead, as shown in FIGS. 54 and 55, the second storage unit 131 is directly disposed under the cleaning notch 111, to be connected with the cleaning notch 111. In this case, the dirty cleaning fluid automatically flows from the cleaning notch 111 into the second storage unit 121 under gravity, so that the structure is allowed to be simpler, the usage is more convenient, and the cost is lower.

To realize a better effect in cleaning the mop member 22111, as well as to satisfy more diverse usage needs of users and pursuit higher life quality, the cleaning fluid supply device 12 in the present disclosure may further include an auxiliary material supply device, which is configured to supply an auxiliary material required for cleaning the mop member 22111, such as a disinfectant, a fragrance, and a wax layer for waxing. The auxiliary material supply device may directly supply the auxiliary material to the cleaning notch 111, or supply the auxiliary material to the first storage unit 121, so that the auxiliary material is first mixed with the cleaning fluid, and then the mixed auxiliary material and cleaning fluid together flow into the cleaning notch 111 under the driving force of the first power device.

It should be noted that, in other embodiments according to the present disclosure, excluding the cleaning fluid supply device 12 and/or the dirty fluid collection device 13, instead, the base station 1 is directly arranged near a position where a tap water pipe and/or a drain pipe are installed. In this way, the base station 1 can directly use the tap water supplied from the tap water pipe to clean the mop member 22111, and the dirty fluid after the cleaning can be directly discharged through the drain pipe. In this way, the structure of the base station is simpler and the cost is lower.

Figure 42:
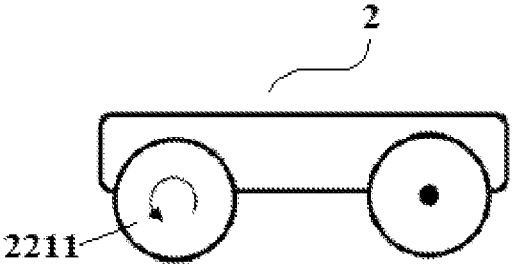
FIG. 42 is a structure view of the cleaning robot having the mop unit that is rotatable around the horizontal axis according to a fourth embodiment.
Figure 43:
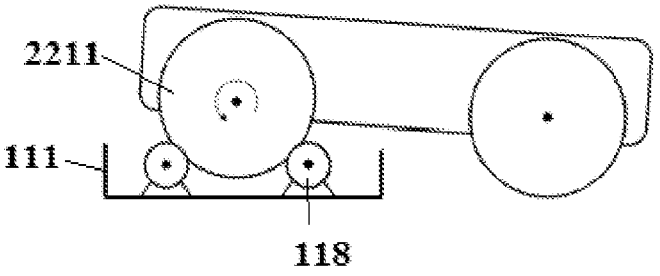
FIG. 43 illustrates a mechanism of the base station with the cleaning roller cleaning the mop member of the cleaning robot shown in FIG. 42.

In the above three embodiments, the mop drive mechanisms 2212 for driving the mop units 2211 to rotate relative to the chassis 202 all use the worm gear and worm mechanisms to transmit opposite torques to the two output shafts 22123. However, in other embodiments according to the present disclosure, a gear wheel mechanism may be used to transmit opposite torques to the two output shafts 22123. As explained in the first embodiment, to solve the poor mopping effect of the existing cleaning robot 2, the mop unit 2211 may be arranged to be driven to rotate around the vertical axis relative to the chassis 202 by the mop drive mechanism 2212 as in the above three embodiments, or may be arranged to be driven to rotate around the horizontal axis by the mop drive mechanism 2212. FIGS. 42 and 43 show the cleaning robot system in the fourth embodiment having the mop unit 2211 rotated around the horizontal axis.

As shown in FIG. 42, in the fourth embodiment, the mop unit 2211 of the cleaning robot 2 includes a roller that can rotate horizontally and a mop member 22111 arranged on the outer surface of the roller. The mop drive mechanism 2212 drives the mop unit 2211 to rotate around the horizontal axis, which enhances the relative movement between the mop member 22111 and the floor, thereby increasing the mopping force and the number of times of mopping, as well as realizing both the mopping and sweeping functions. Therefore, the effect in mopping the mop member 22111 is improved.

In regard to the cleaning robot 2 in this embodiment, a base station 1 different from those in the foregoing three embodiments is provided. As shown in FIG. 43, in this embodiment, the mop member cleaning device 11 includes a cleaning roller 118, the cleaning roller 118 which is configured to clean the mop member 22111 is arranged in the cleaning notch 111 of the mop member cleaning device 11 of the base station 1. The cleaning roller 118 is in contact with the mop member 22111 during the process of the mop member cleaning device 11 cleaning the mop member 22111, the mop member 22111 is pressed against and supported by the cleaning roller 118, so that the relative rotation of the cleaning roller 118 and the mop member 22111 can achieve the purpose of cleaning the mop member 22111. The relative rotation of the cleaning roller 118 and the mop member 22111 can be realized by an active rotation of the mop member 22111, or an active rotation of the cleaning roller 118, or active rotations of both the cleaning roller 118 and the mop member 22111 with different directions and/or different speeds. The active rotation of the mop member 22111 is preferable, because the active rotation of the mop member 22111 can be realized by the driving of the mop drive mechanism 2212 of the cleaning robot 2, and there is no need to provided an extra mechanism on the base station 1 for driving the cleaning roller. Thus, the base station 1 has a simpler structure and a reduced cost. In addition, the active rotation of the mop member 22111 also plays a role in drying, to maintain the mop member 22111 suitably moist after cleaning. The mop member cleaning device 11 with the cleaning roller 118 is applicable to other embodiments according to the present disclosure.

To improve the cleaning performance of the cleaning robot 2, in the fourth embodiment, a rubbish scraping member which is configured to scrape rubbish adhered to the cleaning device 22 is further arranged on the cleaning device 22. The rubbish scraping member may be a scraping blade 2312, or a roller brush 2312', and the corresponding structures of the two cleaning robots 2 are respectively shown in FIGS. 44 and 45.

Figure 44:
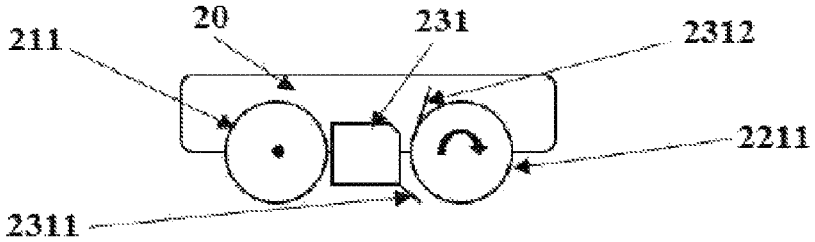
FIG. 44 illustrates a variant of the cleaning robot according to the fourth embodiment shown in FIG. 43.

In the cleaning robot 2 as shown in FIG. 44, the rubbish scraping member uses the scraping blade 2312. The scraping blade 2312 which can be contact with the rotated mop member 22111 is arranged on the housing 20 of the cleaning robot 2. In this way, during the process that the mop member 22111 rotates to clean the floor, each time the mop member 22111 comes into contact with the scraping blade 2312, the scraping blade 2312 scrapes the rubbish adhered to the mop member 22111, thereby maintaining the cleanness of the mop member 22111, and ensuring the quality of floor cleaning.

Figure 45:
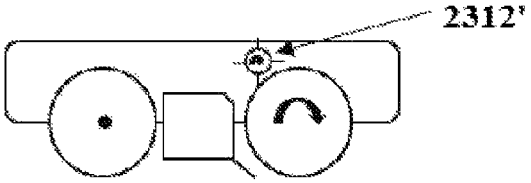
FIG. 45 illustrates a variant of the cleaning robot shown in FIG. 44.

In the cleaning robot 2 as shown in FIG. 45, the rubbish scraping member uses the roller brush 2312'. The roller brush 2312' that the rotation direction is the same with the mop member 22111 is arranged on the housing 20. The co-directional contact friction between the roller brush 2312' and the mop member 22111 can scrape the rubbish off the mop member 22111. In addition, the rotation of the roller brush 2312' can throw the rubbish to the rubbish collection device 23, thereby facilitating the rubbish collection.

In addition, referring FIGS. 44 and 45, in these two types of cleaning robots 2, both of the two rubbish collection devices 23 include blocking plates 2311. The blocking plate 2311 obliquely extends downward to the floor surface from the collection port (the dust suction port 236) of the rubbish collection device 23. Based on this, the blocking plate 2311 can block the rubbish gathered to the position thereof, and prevent the rubbish cleaned by the cleaning device 22 from spreading out of the range that the collection port can collect, thereby to facilitate the collection of the rubbish collection device 23, and avoid the rubbish to cause a secondary pollution to the floor after cleaning. In particular, when the mop member 22111 rotates relative to the chassis 202 of the cleaning robot 2 around the vertical axis, the blocking plate 2311 prevents the gathered rubbish from being carried away from the collection port by the mop member 22111. And the blocking plate 2311 can be cooperated with the aforementioned rubbish scraping member, to facilitate a more thorough rubbish collection of the rubbish collection device 23. The rubbish scraping member and the blocking plate 2311 shown in FIGS. 44 and 45 are applicable to other embodiments according to the present disclosure.

Figure 46:
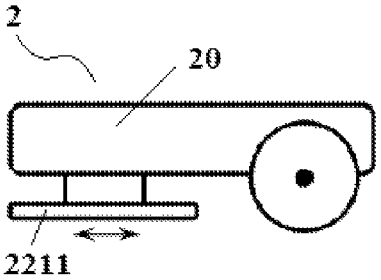
FIG. 46 is a structure view of a cleaning robot having a mop unit that is horizontally reciprocable according to a fifth embodiment.
Figure 47:
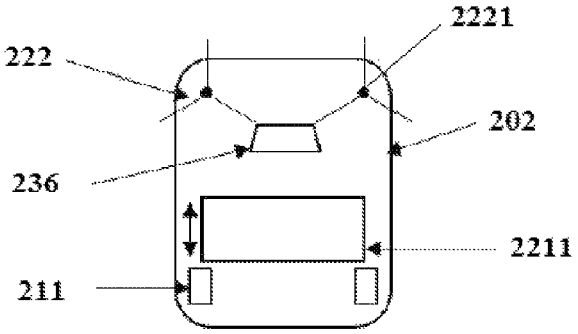
FIG. 47 illustrates a variant of the cleaning robot according to the fifth embodiment shown in FIG. 46.

In addition, the foregoing embodiments all take the example that the mop unit 2211 rotates relative to the chassis 202 for description. However, to increase the relative movement of the mop unit 22111 and the floor to improve the mopping effect, the mop unit 2111 in the present disclosure may be arranged to horizontally reciprocate relative to the chassis 202. That is, better mopping effect can be achieved not only by the rotation of the mop unit 2211 relative to the floor surface but also by the horizontal reciprocation of the mop unit 2211 relative to the floor surface. In the embodiment as shown in FIGS. 46 and 47, the mop unit 2211 can horizontally reciprocate relative to the chassis 202. In this case, the mop member 22111 cleans the floor surface by a pushing cleaning mode, that is, the mop member 22111 cleans the stain or rubbish by moving back and forth to mop the floor, which is similar to the manual mopping mode, and can reduce the rubbish leftover at the rear of the mop device 2211. It is more convenient for the cleaning robot 2 having the mop unit 2211 which can reciprocate horizontally to cooperate with the base station 1, the cleaning of the mop member 22111 can be realized during the process that the mop member cleaning device 11 and the mop member 22111 move relative to each other. In addition, in the present disclosure, the mop unit 2211 of the cleaning robot 2 is arranged to rotate relative to the chassis 202, or horizontally reciprocate relative to the chassis 202. And during the process of cleaning the floor, it is preferable to perform the rotation for mopping first and then the pushing for mopping, which takes advantages of the rotation mopping and the pushing mopping, thereby to achieve more effective floor cleaning.

Additionally, in the foregoing embodiments, the cleaning devices 22 include only the mop devices 221. However, in other embodiments according to the present disclosure, the cleaning device 21 may further include the sweeping device 222 for sweeping the floor, so that the cleaning robot 2 can clean the floor with both the mop device 221 and the sweeping device 222, achieving a better cleaning effect. The sweeping device 222 may be disposed in front of and/or behind the mop device 221, preferably in front of the mop device 221, so as to realize a cleaning mode of "sweeping first and then mopping". The sweeping device 222 cleans most of the rubbish (dust and large particulates), and then the mop device 221 cleans the remaining difficult-to-clean rubbish (such as stubborn stains), thereby improving the quality of floor cleaning. FIG. 47 shows one of the embodiments. As shown in FIG. 47, in this embodiment, the cleaning device 22 includes a mop unit 2211 which can horizontally reciprocate and a side brush 2221 disposed in front of the mop unit 2211 and served as the sweeping device 222, the dust suction port 236 is disposed between the mop unit 2211 and the side brush 2221, the floor can be cleaned with the cooperation of the dust suction port 236, the mop unit 2211 and the side brush 2221. Those skilled in the art can understand that the sweeping device 222 is not limited to the side brush 2221, and various types of sweeping devices 222 can be used to cooperate with various types of mop units 2211.

As an improvement to the above embodiments, the mop unit 2211 further comprises a sweeping member (such as a bristles or a brush), the sweeping member may be arranged on the edge of the mop member 22111 of the above-mentioned mop unit 2211, so that the mop unit 2211 itself becomes an integrated structure with both the sweeping and mopping functions. On condition that the specific sweeping device 222 is not provided, the mop unit 2211 itself can fully gather rubbish (especially hair), so as to achieve a better cleaning effect. In addition, when the mop unit 2211 cleans floor edge, the sweeping member arranged on the edge of the mop member 22111 can be in close contact with this area, which expands the cleaning range of the mop device 221, thereby allowing the cleaning robot 2 to effectively clean the corner part of the house.

In the foregoing embodiments, the swinging of the mop unit 2211 relative to the chassis 202 is implemented by the swingable connection between the mop unit 2211 and the mop drive mechanism 2212, but the implementation way is not limited thereto. For example, the swinging of the mop unit 2211 may also be implemented by that the mop drive mechanism 2212 is swingably connected to the chassis 202. In this case, the mop unit 2211 and the mop drive mechanism 2212 are connected in a non-swinging way (for example, the two are fixedly connected). Actually, on condition that the mop unit 2211 is connected with the chassis 202 by the mop drive mechanism 2212, the mop unit 2211 is swingably connected with the mop drive mechanism 2212, and/or, the mop drive mechanism 2212 is swingably connected with the chassis 202. By both ways, the swinging of the mop unit 2211 relative to the chassis 202 can be realized. For another example, on condition that the mop unit 2211 does not rotate and/or horizontally reciprocate relative to the chassis 202, the mop drive mechanism 2212 may be replaced with a mop connection structure of non-driving mode connecting the mop unit 2211 and the chassis 202. In this condition, to realize the swinging of the mop unit 2211 relative to the chassis 202, the mop unit 2211 may be swingably connected with the mop connection structure of non-driving mode, and/or, the mop connection structure of non-driving mode may be swingably connected with the chassis 202.

As can be seen, in the present disclosure, the mop connection structure connecting the mop unit 2211 and the chassis 202 may be either a mop connection structure of driving mode (such as the mop drive mechanism 2212 in the foregoing embodiments), or a mop connection structure of non-driving mode (for example, the connection shaft connected between the mop unit 2211 and the chassis 202). Regardless of the mode of the mop connection structure, when the mop unit 2211 is swingably connected to the mop connection structure, and/or the mop connection structure is swingably connected to the chassis 202, the mop unit 2211 can be swingably connected to the chassis 202 by the mop connection structure.

It should be noted that, in the present disclosure, the rubbish collection device 23 may adopt other structures. For example, without arranging the dust removal fan 234 and the fan duct 235, the rubbish can enter the inside of the rubbish collection device 23 through the collection port, under its own inertia and the gathering action of the cleaning device 22. In this case, the rubbish collection device 23 exerts no additional action on the rubbish, which only acts as a dustpan.

The foregoing description merely portrays some illustrative embodiments in accordance with the present disclosure and therefore is not intended to limit the scope of the present disclosure. Any modifications, equivalents, improvements, etc. made within the spirit and scope of the present disclosure shall fall in the scope of protection of the present disclosure.

What is claimed is:

1. A base station for a cleaning robot system, wherein, the cleaning robot system comprises the base station and a cleaning robot, the cleaning robot comprises a mop member that is configured to mop a floor, the base station is arranged to be independent to the cleaning robot of the cleaning robot system, and the base station comprises a base station body and a mop member cleaning device arranged on the base station body, the mop member cleaning device is configured to clean the mop member;

the mop member cleaning device comprises a cleaning notch and two fluid inlet structures;

wherein the fluid inlet structures are symmetrically arranged at the bottom of the cleaning notch with respect to a central axis of a width direction of the mop member cleaning device, and are configured to inject cleaning fluid onto the mop member in a manner of spraying to clean the mop member.

2. The base station of claim 1, wherein the cleaning notch is configured to receive the cleaning fluid for cleaning the mop member through the fluid inlet structures.

3. The base station of claim 2, wherein the mop member cleaning device comprises a fluid discharge structure for discharging dirty cleaning fluid outside of the cleaning notch after cleaning the mop member; and wherein the two fluid inlet structures are symmetrically arranged with respect to the fluid discharge structure.

4. The base station of claim 2, wherein the cleaning notch is configured to place the mop member during a process of the mop member cleaning device cleaning the mop member.

5. The base station of claim 1, wherein the mop member cleaning device is rotated relative to the mop member during a process of the mop member cleaning device cleaning the mop member.

6. The base station of claim 5, wherein the mop member cleaning device is remained static during the process of cleaning the mop member.

7. The base station of claim 1, wherein the mop member cleaning device is moved relative to the mop member during a process of the mop member cleaning device cleaning the mop member.

8. The base station of claim 7, wherein the mop member cleaning device is remained static during the process of cleaning the mop member.

9. The base station of claim 1, wherein the mop member cleaning device comprises a cleaning roller configured to contact with the mop member during a process of the mop member cleaning device cleaning the mop member.

10. The base station of claim 9, wherein the cleaning roller is rotated relative to the mop member during the process of the mop member cleaning device cleaning the mop member.

11. The base station of claim 10, wherein the cleaning roller is configured to the driven by an active rotation of the mop member.

12. The base station of claim 11, wherein the mop member cleaning device comprises at least two cleaning rollers, the two cleaning rollers are arranged in parallel intervals, a space between the two cleaning rollers is less than a radial dimension of the mop member, and the two cleaning rollers are supported on both sides of a bottom of the mop member.

13. The base station of claim 10, wherein the cleaning roller is configured to rotate actively to drive the mop member.

14. The base station of claim 10, wherein the cleaning roller is configured to rotate actively in a direction different from a direction of active rotation of the mop member.

15. The base station of claim 10, wherein the cleaning roller is configured to rotate actively in a speed different from a speed of active rotation of the mop member.

16. The base station of claim 1, wherein the base station is connected to a tap water pipe and directly uses tap water supplied from the tap water pipe to clean the mop member.

17. The base station of claim 1, wherein the base station is connected to a drain pipe and discharges dirty fluid after cleaning the mop member directly through the drain pipe.

18. A cleaning robot system, comprising a cleaning robot, the cleaning robot comprising a moving device that is configured to drive the cleaning robot to move on floor, and a cleaning device that is configured to clean the floor, the cleaning device comprising a mop device, the mop device comprising a mop unit, the mop unit comprising a mop member that is configured to mop the floor, wherein, the cleaning robot system further comprises a base station comprising a base station body and a mop member cleaning device arranged on the base station body, the mop member cleaning device is configured to clean the mop member;

the mop member cleaning device comprises a cleaning notch and two fluid inlet structures;

wherein the fluid inlet structures are symmetrically arranged at the bottom of the cleaning notch with respect to a central axis of a width direction of the mop member cleaning device, and are configured to inject cleaning fluid onto the mop member in a manner of spraying to clean the mop member.

19. The cleaning robot system of claim 18, wherein the mop member cleaning device and the mop member are rotated relative to each other during a process of the mop member cleaning device cleaning the mop member.

20. The cleaning robot system of claim 19, wherein the mop member is rotated during the process of the mop member cleaning device cleaning the mop member to throw away dirty cleaning fluid after cleaning from the mop member by utilizing an action of a centrifugal force generated by the rotation of the mop member.

* * * * *